United States Patent [19]

Yokoyama

[11] Patent Number: 5,009,280

[45] Date of Patent: Apr. 23, 1991

[54] ACOUSTIC APPARATUS

[75] Inventor: Kenji Yokoyama, Hamamatsu, Japan

[73] Assignee: Yamaha Corporation, Hamamatsu, Japan

[21] Appl. No.: 328,473

[22] Filed: Mar. 24, 1989

[30] Foreign Application Priority Data

Apr. 1, 1988 [JP] Japan ..... 63-81032
Apr. 1, 1988 [JP] Japan ..... 63-81033

[51] Int. Cl.[5] ..... H04R 1/28; H04R 3/04

[52] U.S. Cl. ..... 181/160; 181/153; 181/156; 381/93; 381/96; 381/159

[58] Field of Search ..... 181/141, 148, 153, 155, 181/156, 160; 381/93, 96, 98, 159

[56] References Cited

U.S. PATENT DOCUMENTS 3,821,423 6/1974 Mullins ..... 381/96
3,984,635 10/1976 Nestorovic et al. ..... 381/89
4,092,494 5/1978 Micheron ..... 381/24 X
4,180,706 12/1979 Bakgaard ..... 381/96
4,549,631 10/1985 Base ..... 181/160 X

*Primary Examiner*—Benjamin R. Fuller
*Attorney, Agent, or Firm*—Spensley Horn Jubas & Lubitz

[57] ABSTRACT

An acoustic apparatus for improved bass sound reproduction comprising a resonator, a vibrator, and a vibrator drive means, the resnoator having a passive diaphragm serving as a resonance radiation unit for radiating an acoustic wave by resonance, the vibrator having an active diaphragm provided for the resonator, and the vibrator drive means having a drive control means for controlling a drive condition so as to cancel atmospheric counteraction of said resonator at the time of driving of the resonator, whereby the vibrator may be invalidated as viewed from the resonator, and the vibrator and the resonator can be independently designed.

8 Claims, 16 Drawing Sheets

ACOUSTIC APPARATUS

BACKGROUND OF THE INVENTION

1. Field of the Invention

The present invention relates to an acoustic apparatus comprising a resonator or using a resonator as an acoustic radiation member.

2. Prior Art

A speaker system as one type of acoustic apparatus is arranged such that a speaker unit (vibrator) is disposed in a cabinet and is driven by an amplifier (AMP). Of reproduction characteristics of the speaker system, low-frequency reproduction characteristics are mainly determined by the volume of the cabinet.

When a dynamic direct radiator speaker (dynamic cone speaker) is used in an acoustic apparatus, a direct sound is radiated from the front surface of the diaphragm, and acoustic waves are also radiated from its rear surface. The phase of the acoustic waves from the front and rear surfaces are opposite to each other. Therefore, if a difference in propagation distance of the acoustic waves from the front and rear surfaces to a listener is almost an odd multiple of a half wavelength, sound pressures from these surfaces are in phase with each other, and are superposed.

However, if the difference in propagation distance of the acoustic waves is almost an even multiple of the half wavelength, the sound pressures cancel each other and are attenuated. Thus, taking into consideration the fact that sounds having various wavelengths are radiated from the speaker, it is preferable that the sound from the rear surface does not reach the listener or does not adversely influence the direct radiation sound from the front surface.

For this purpose, the direct radiation speaker employs a baffle. As a baffle for shielding communication of sounds from the front and rear surface of the diaphragm, a plane baffle, back-opening cabinet type baffle, closed baffle, and the like are known. Furthermore, as a baffle having a slightly different purpose from the above baffles, a phase inversion type (bass-reflex type) baffle is known. (In this specification, these baffles are referred to as first to fourth prior arts, respectively.)

In such conventional acoustic apparatuses described above, various countermeasures are taken in order to allow low-frequency reproduction.

The plane baffle, back-opening baffle and closed baffle are designed such that radiation sounds from the rear surface of the diaphragm do not reach a listener in front of the speaker system as unnecessary sounds. However, in order to improve the bass reproduction characteristics with these baffles, the apparatus (cabinet) will inevitably be made large in size, and even if it is made so to a certain feasible extent, its low-frequency reproduction characteristics will be insufficient.

In the bass-reflex type speaker system, the phase of the backward sound is inverted by the opening port, so that, in particular, a bass range of a direct radiation sound from the front surface of the diaphragm is compensated for. However, at that time, the resonance system which is originally very hard to deal with is undesirably formed on the two portions, i.e., the diaphragm and the opening port. In order to obtain a satisfactory bass-reflex effect according to the standard setting, the optimal condition of the system must be very critically set while taking the mutual dependency condition of these two resonance systems. Although various attempts have been made in this respect as disclosed in Japanese Patent Publication No. sho 46-12670 and Japanese Utility Model Publication No. sho 54-35068, these attempts could not eliminate difficulty on design.

Whether the optimal design of said speaker system has been achieved or not, the cabinet undesirably becomes bulky in order to improve the low-frequency reproduction characteristics.

Therefore, when a bass reproduction capability of a certain level or higher is to be obtained according to any of the prior arts, the resulting cabinet will inevitably become large in size. As a result, it is difficult to employ an acoustic apparatus having a cabinet of a proper volume and excellent low-frequency reproduction characteristics in a variety of applications such as in halls, rooms, vehicles, and the like.

As is so in the bass-reflex speaker system described above, in an acoustic apparatus, a resonance phenomenon is utilized in a variety of forms.

There has been known, as a fifth prior art, an acoustic apparatus comprising a resonator partitioned into two chambers A and B by a partition wall, and a dynamic electroacoustic transducer (dynamic speaker) serving as a vibrator and being attached to a hole formed in the partition wall. In this acoustic apparatus, opening ducts are provided respectively to the chambers A and B, and resonance acoustic waves are radiated outwards from these ducts. The chambers A and B respectively have resonance frequencies $f_{oa}$ (Hz) and $f_{ob}$ (Hz) determined by the volumes of cavities (i.e. the volumes of chambers A and B), the dimensions of the opening ducts, and the like. Therefore, when the speaker is driven by an amplifier or the like, in the chambers A and B, a resonance phenomenon occurs by the vibration of the diaphragm of the speaker, and an output energy at that time has maximum values near the above-mentioned resonance frequencies. As a result, there can be obtained the resonance acoustic waves having sound pressure-frequency characteristics having peaks at said respective frequencies $f_{oa}$ and $f_{ob}$.

There has been also known, as a sixth prior art, an acoustic apparatus comprising a resonance chamber defined by a cabinet, a first dynamic electro-acoustic transducer (speaker) serving as a vibrator and being attached to the resonance chamber, and an opening, formed in the resonance chamber, for radiating outwards a resonance acoustic wave. A second dynamic electro-acoustic transducer (speaker) is separately provided to said cabinet, so that an acoustic wave is directly radiated outwards therefrom. In this acoustic apparatus, when the first speaker is driven by an amplifier, a resonance phenomenon occurs in the resonance chamber due to the vibration of the diaphragm of the first speaker. Therefore, separately from the direct radiation by the second speaker, acoustic reproduction is made from the opening to have a peak sound pressure near a resonance frequency $f_o$ inherent in the resonance chamber.

However, according to the conventional acoustic apparatuses, the vibrator undesirably causes a decrease in resonance Q value of the resonator serving as an acoustic radiation member. This is because the speaker as the vibrator has an inherent internal impedance $Z_v$, and the internal impedance acts as an element which damps the resonance of the resonator. In this manner, as the resonance Q value becomes low, radiation capability of the resonance acoustic wave becomes inevitably low, and the presence of the resonator in the acoustic apparatus becomes meaningless.

If the resonance frequency is lowered while rendering the resonator compact, the opening duct must be elongated. Accordingly, the acoustic resistance (mechanical resistance) of the opening duct is inevitably increased, and the resonance Q value is decreased further. For this reason, the acoustic radiation capability is further decreased due to the decrease in the resonance Q value, and the acoustic apparatus is not suitable for a practical use.

As a result, any of the conventional apparatuses does not have sufficient resonance radiation capability. If a certain level of capability is to be maintained, the resulting cabinet will inevitably be made extremely large in size.

SUMMARY OF THE INVENTION

The present invention has been made in consideration of the above situation, and has for its first object to provide an acoustic apparatus which can appropriately and independently set a volume of a cabinet or the like constituting the acoustic apparatus and low-frequency reproduction characteristics, and can remove or reduce a mutual dependency condition of a vibrator and a resonator.

It is a second object of the present invention to provide an acoustic apparatus which can realize sufficient acoustic radiation capability and can be rendered compact.

The acoustic apparatus in a first aspect of the present invention comprises a resonator having a passive diaphragm serving as a resonance radiation unit for radiating an acoustic wave by resonance, a vibrator provided for the resonator, and a vibrator drive means for driving the vibrator. The vibrator has an active diaphragm comprising a direct radiator portion for directly radiating an acoustic wave outwards and a resonator driver portion for driving the resonator. The vibrator drive means has a drive control means for controlling the drive condition so as to cancel the atmospheric counteraction of said resonator at the time of driving of the resonator by the vibrator.

With the above arrangement, the resonator is driven by the resonator driver portion of the active diaphragm constituting the vibrator. Therefore, an acoustic wave is directly radiated outwards from the direct radiator portion of the active diaphragm, and an acoustic wave by resonance is radiated outwards from the passive diaphragm serving as the resonance radiation unit of the resonator.

The vibrator has an inherent internal impedance, and the vibrator drive means has the drive control means for controlling the drive condition so as to cancel the atmospheric counteraction of the resonator to the vibrator at the time of driving of the resonator by the vibrator. Therefore, in the case in which the vibrator drive means comprises a means for equivalently generating a negative impedance component in the output impedance, said internal impedance can be apparently reduced (or preferably invalidated) by the operation of the drive control means.

In the meantime, as is seen from an electric equivalent circuit, the vibrator comprises a series circuit constituted by the internal impedance and an equivalent motional impedance contributing to practical vibration. A motional signal represents the voltage applied to the equivalent motional impedance, its differential or integral output, or the like, and corresponds to the real movement of the diaphragm of the vibrator, e.g. velocity, acceleration, deviation (or amplitude), or the like of the vibration. Accordingly, in the case that a motional feedback means is provided in the vibrator drive means, the motional signal is detected and negatively fed back to the input side of the vibrator drive means. Therefore, the drive condition of the vibrator drive means is brought under follow-up control so that a signal in an amount corresponding to drive input is always correctly transmitted as the voltage applied to the equivalent motional impedance, or its differential or integral voltage. More specifically, the vibrator drive means equivalently appears to directly and linearly drive the equivalent motional impedance itself of the vibrator, whereby the internal impedance inherent in the vibrator existing between the vibrator drive means and the equivalent motional impedance of the vibrator is apparently reduced, as in a case where a negative impedance generating means is substituted for the motional feedback means.

For this reason, when a means for generating a negative impedance is arranged or when a motional feedback means is arranged in the vibrator drive means, the vibrator is now an element responsive to only an electrical drive signal input, and will not function as a resonance system. At the same time, the volume of the resonator is no longer a factor which influences low-frequency reproduction capability of the vibrator. Thus, if the cabinet is rendered compact, bass reproduction without including distortion due to a transient response of the vibrator can be realized. The resonance frequency of the resonator may be easily lowered by increasing the equivalent mass of the passive diaphragm, and a decrease in an acoustic radiation capabilities which is caused by lowering the resonance frequency can be slight in term of sound pressure level as compared with such decrease which is caused by increasing an air equivalent mass. In addition, since the internal impedance inherent in the vibrator is apparently lowered, the vibrator (active diaphragm) provided for the resonator will not cause a decrease of the resonance Q value. If the equivalent mass of the passive diaphragm is made heavier to lower the resonance frequency, there is remarkably appeared an effect that the decrease in acoustic radiation capabilties is slight. As a result, sufficient acoustic radiation capabilities of the resonator can be realized.

Further, when a cabinet is made small in size, the passive diaphragm does not need any magnetic circuit for driving the passive diaphragm. In addition, since the stroke width can be arbitrarily decreased by increasing the caliber or diameter of the passive diaphragm, the acoustic apparatus according to the present invention can be suitably minimized toward the depth. Thus, a thin shaped cabinet can be readily realized.

As shown in the mechanical or electric equivalent circuit, since a vibration system constituted by the vibrator and a resonance system constituted by the resonator can be dealt with independently as much as possible (preferably, completely independently), the mutual dependency between the above systems on design can be eliminated (or preferably, removed) without causing any problem. Thus, designing can be much facilitated.

As described above, the compact size and super-bass (heavy bass) reproduction can be simultaneously achieved, and designing can be facilitated.

The acoustic apparatus in a second aspect of the present invention comprises a resonator having a passive diaphragm serving as a resonance radiation unit for radiating an acoustic wave by resonance, a vibrator provided for the resonator, and a vibrator drive means for driving the vibrator. The vibrator has an active diaphragm comprising a resonator driver portion for driving the resonator. The vibrator drive means has a drive control means for controlling the drive condition so as to cancel the atmospheric counteraction of said resonator at the time of driving of the resonator by the vibrator.

With the above arrangement, the resonator is driven by the resonator driver portion of the active diaphragm constituting the vibrator. Therefore, an acoustic wave by resonance is radiated outwards from the passive diaphragm serving as the resonance radiation unit of the resonator.

The vibrator has an inherent internal impedance, and the vibrator is driven so as to cancel the atmospheric counteraction of the resonator at the time of driving of the resonator. For this reason, the active diaphragm equivalently becomes a wall of the resonator, and the presence of the vibrator is invalidated when viewed from the resonator. Therefore, the internal impedance inherent in the vibrator is no longer a factor which causes a decrease in resonance Q value of the resonator. For this reason, when the drive control means comprises a means for generating a negative impedance or a motional feedback means, the resonance Q value of the resonator can be extremely high. Although the acoustic resistance of the resonator is increased if the resonator is rendered compact and the resonance frequency is lowered, according to the present invention, even in a case wherein the resonance Q value becomes very small in a conventional drive method, the resonance Q value is not decreased by the presence of the vibrator. The resonance frequency of the resonator may be easily lowered by increasing the equivalent mass of the passive diaphragm, and a decrease in acoustic radiation capabilities which is caused by lowering the resonance frequency can be slight in terms of sound pressure level as compared with such a decrease which is caused by increasing an air equivalent mass. In addition, since the internal impedance inherent in the vibrator is apparently lowered, the vibrator (active diaphragm) provided for the resonator will not cause a decrease of the resonance Q value. If the equivalent mass of the passive diaphragm is increased to lower the resonance frequency, there is remarkably appeared an effect that the acoustic radiation capability is scarcely reduced. As a result, sufficient acoustic radiation capability of the resonator can be realized.

Further, when a cabinet is made small in size, the passive diaphragm does not need any magnetic circuit for driving the passive diaphragm. In addition, since the stroke width can be arbitrarily decreased by increasing the diameter of the passive diaphragm, the acoustic apparatus according to the present invention can be suitably minimized toward the depth. Thus, a thin shaped cabinet can be readily realized.

Figure 1A:
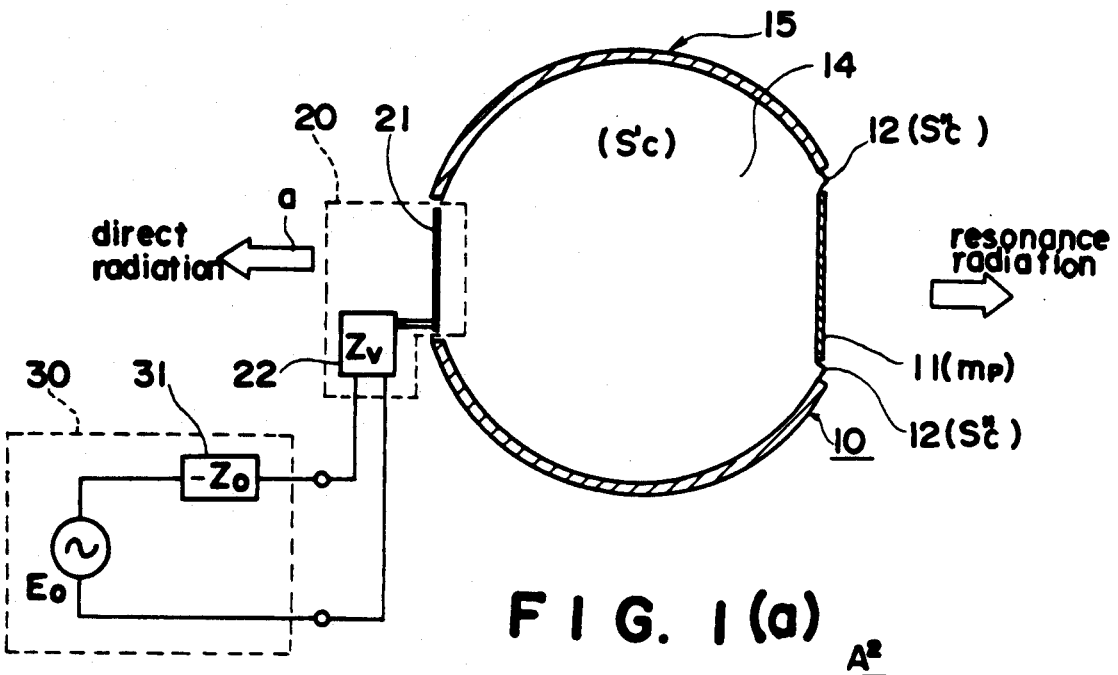
FIGS. 1(*a*) and 1(*b*) are diagrams for explaining a basic arrangement of a first embodiment of the present invention.

DETAILED DESCRIPTION OF THE PREFERRED EMBODIMENTS:

Preferred embodiments of the present invention will be described hereinafter with reference to FIGS. 1 to 19. The same reference numerals in the drawings denote the same parts to avoid repetitive descriptions.

Figure 1B:
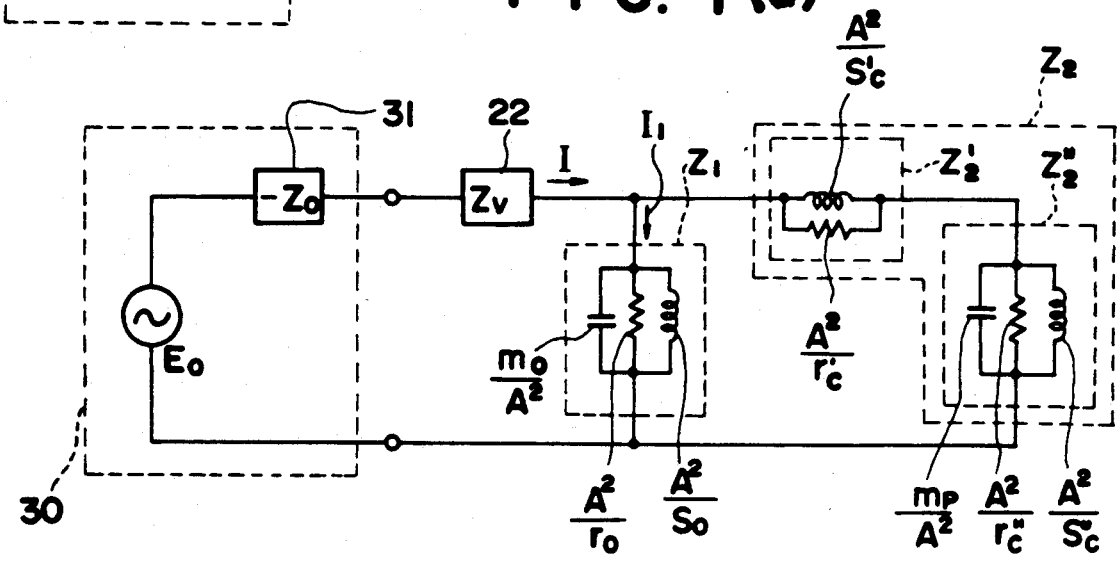
Figure 2:
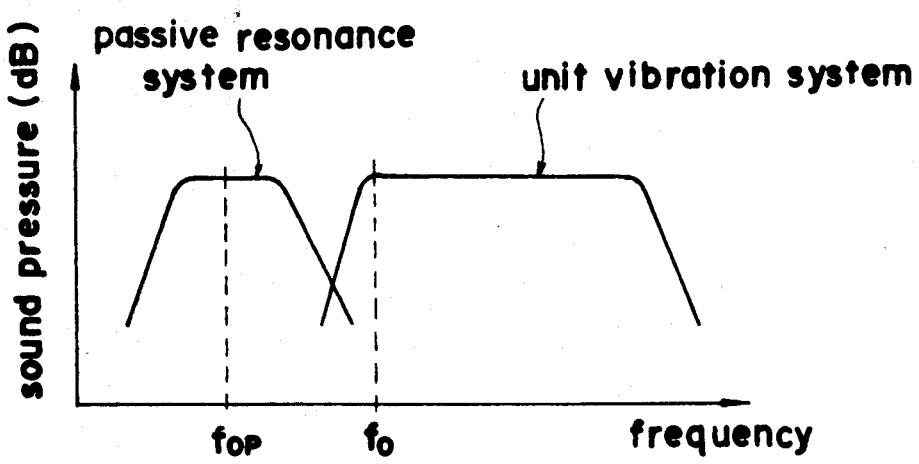
FIG. 2 is a graph showing sound pressure-frequency characteristics of the apparatus shown in FIG. 1(*a*)

FIGS. 1(*a*) and 1(*b*) show a basic arrangement of a first embodiment of the present invention. As shown in FIG. 1(*a*), in this embodiment, a resonator 10 having a passive diaphragm 11 serving as a resonance radiation unit is used. In the resonator 10, a resonance phenomenon is caused by a closed cavity (hollow drum) 14 formed in the body portion 15 of the resonator 10, and the passive diaphragm 11 attached to the body portion 15 with the fringe portion 12. The resonance frequency $F_{op}$ is given by:

$$f_{op}=(S_c/m_p)^{1/2}/2\pi \quad (1)$$

where $s_c$: total of the stiffness $S_c'$ of the cavity 14 and the stiffness $S_c''$ of the fringe portion 12; $(S_c'+S_c'')$ $m_p$: equivalent mass of the passive diaphragm 11

In the acoustic apparatus of this embodiment, a vibrator 20 constituted by an active diaphragm 21 and a transducer 22 is attached to the body portion 15 of the resonator 10. The transducer 22 is connected to a vibrator driver 30, which comprises a negative impedance generator unit 31 for equivalently generating a negative impedance component ($-Z_O$) in the output impedance.

FIG. 1(*b*) shows an arrangement of an electric equivalent circuit of the acoustic apparatus shown in FIG. 1(*a*). In FIG. 1(*b*), a parallel resonance circuit $Z_1$ corresponds to an equivalent motional impedance of the vibrator 20, $r_o$ designates an equivalent resistance of a vibration system; $S_o$ an equivalent stiffness of the vibration system; and $m_o$ an equivalent mass of the vibration system. A series resonance circuit $Z_2$ corresponds to an equivalent motional impedance of the resonator 10 comprising a series circuit constituted by the cavity of the resonator 10 expressed as a circuit $Z_2'$, and the passive diaphragm 11 and the fringe portion 12 expressed as a circuit $Z_2'$, $r_c'$ designates an equivalent resistance of the cavity of the resonator 10, and $r_c''$ designates an equivalent resistance of the fringe portion 12. In the Figure, reference symbol A denotes a force coefficient. For example, if the vibrator is a dynamic direct radiation speaker, A=Bl where B is the magnetic flux density in the magnetic gap, and l is the length of the voice coil conductor. Furthermore, in the Figure, $Z_v$ designates an inherent internal impedance of the transducer 22.

The operation of the acoustic apparatus with the arrangement shown in FIG. 1(*a*) will be briefly described below.

When a drive signal is supplied from the vibrator driver 30 having a negative impedance drive function to the transducer 22 of the vibrator 20, the transducer 22 electro-mechanically converts the drive signal so as to reciprocally drive the active diaphragm 21 forward and backward (in the right and left directions in the Figure), the active diaphragm 21 mechano-acoustically converts this reciprocal motion. Since the vibrator driver 30 has the negative impedance drive function, the internal impedance inherent in the transducer 22 is effectively decreased (ideally invalidated). Therefore, the transducer 22 drives the active diaphragm 21 faithfully in response to the drive signal from the vibrator driver 30, and independently supplies a drive energy to the resonator 10. In this case, the front surface side (the left surface side in the Figure) of the active diaphragm 21 serves as a direct radiator portion for directly radiating acoustic waves to the outside, and the rear surface side (the right surface side in the Figure) of the active diaphragm 21 serves as a resonance driver portion for driving the resonator 10.

For this reason, as indicated by an arrow a in the Figure, an acoustic wave is directly radiated from the active diaphragm 21, and air in the resonator 10 as well as the passive diaphragm 11 and the fringe portion 12 is resonated, so that a super-bass acoustic wave having a sufficient sound pressure is resonated and radiated from the passive diaphragm 11 as the resonance radiation unit. By adjusting the equivalent mass of the passive diaphragm 11 and the equivalent stiffness of the fringe portion 12 in the resonator 10, especially by adjusting said equivalent mass, the resonance frequency $f_{op}$ is set to be lower than the reproduction frequency range of the vibrator 20, and the Q value is set to be an appropriate level, so that sound pressure-frequency characteristics shown in, e.g., FIG. 2 can be obtained.

In FIG. 1(*b*), if I denotes a current flowing through the circuit, $I_1$ and $I_2$ denote currents flowing through the parallel and series resonance circuits $Z_1$ and $Z_2$, respectively, and $Z_3=Z_v-Z_O$, equations (2) to (4) below are established:

$$E_v = E_0 \cdot \{Z_1 \cdot Z_2/(Z_1 + Z_2)\}/[\{Z_1 \cdot Z_2/(Z_1 + Z_2)\} + Z_3] \quad (2)$$

$$I_1 = E_0 \cdot \{Z_2/(Z_1 + Z_2)\}/[\{Z_1 \cdot Z_2/(Z_1 + Z_2)\} + Z_3] \quad (3)$$

$$I_2 = E_0 \cdot \{Z_1/(Z_1 + Z_2)\}/[\{Z_1 \cdot Z_2/(Z_1 + Z_2)\} + Z_3] \quad (4)$$

In order to simplify equations (3) and (4), if $Z_4=Z_1 \cdot Z_2/(Z_1=Z_2)$, equation (3) is rewritten as:

$$I_1=E_0/\{Z_1(1+Z_3/Z_4)\} \quad (5)$$

and, equation (4) is rewritten as:

$$I_2=E_0/\{Z_2(1+Z_3/Z_4)\} \quad (6)$$

From equations (5) and (6), the following two points can be understood. First, if the $Z_3$ value approaches zero, the parallel resonance circuit $Z_1$ of the vibrator and the series resonance circuit $Z_2$ of the resonator approach a state wherein they are respectively short-circuited in an AC manner, accordingly. Second, the parallel and series resonance circuits $Z_1$ and $Z_2$ influence each other through $Z_3=Z_v-Z_0$, and the independencies of the parallel and series resonance circuits $Z_1$ and $Z_2$ are enhanced as the $Z_3$ value approaches zero. Assuming an ideal state wherein $Z_3=Z_v-Z_0=0$, equations (5) and (6) are respectively given by:

$$I_1=E_0/Z_1 \quad (7)$$

$$I_2=E_0/Z_2 \quad (8)$$

Both the parallel and series resonance circuits $Z_1$ and $Z_2$ are short-circuited with a zero impedance in an AC manner, and can be regarded as perfectly independent resonance systems.

Strictly examining a resonance system of the vibrator 20 , the two ends of the parallel resonance circuit $Z_1$ formed by the equivalent motional impedance are short-circuited with a zero impedance in an AC manner. Therefore, the parallel resonance circuit $Z_1$ is substantially no longer a resonance circuit. More specifically, the vibrator 20 linearly responds to a drive signal input in real time, and faithfully electro-acoustically converts an electric signal (drive signal) without a transient response. In the vibrator 20, the concept of a lowest resonance frequency $f_o$ which is obtained when the vibrator is simply mounted on the resonator 10 is not applicable. (In the following description, "a value corresponding to the lowest resonance frequency $f_o$ of the vibrator 20" refers to a concept wherein the above-mentioned concept of the resonance is not substantially applicable any longer.) The vibrator 20 and the resonator 10 are independent of each other, and the vibrator 20 and the passive diaphragm 11 are also independent of each other. For this reason, the vibrator 20 functions independently of the volume of the resonator 10, the design specifications of the passive diaphragm 11, the fringe portion 12, and the like (i.e., independently of the equivalent motional impedance of the passive resonance system).

The parallel and series resonance circuits $Z_1$ and $Z_2$ are present as resonance systems independently of each other. Therefore, when the resonator 10 is designed to be compact in order to minimize the system, or when the passive diaphragm is designed to be enlarged in order to lower the resonance frequency of the passive resonance system, the design of the unit vibration system is not influenced at all, and the value corresponding to the lowest resonance frequency $f_o$ of the unit vibration system and the like are not influenced at all, either. For this reason, easy designing free from the mutual dependency condition is allowed.

From another point of view, since the unit vibration system $Z_1$ does not effectively function as a resonance system, if the drive signal input is zero volts, the active diaphragm 21 becomes a part of the wall of the resonator 10. As a result, the presence of the active diaphragm 21 can be ignored when the passive resonance system is considered.

From still another point of view, in the acoustic apparatus of the present invention, the passive resonance system is the only resonance system, and exhibits single-humped characteristics similar to those of the closed baffle.

In the parallel resonance system, the Q value given by the following relation becomes zero for the parallel resonance circuit $Z_1$:

$$\text{(load resistance)}/\text{(resonance impedance)}$$

$Q=0$ in the unit vibration system has some other significances.

First, the vibrator 20 equivalently forming the parallel resonance circuit $Z_1$ becomes a speaker which is driven by a current source given by $E_v/(A^2/r_o)$ which is determined by the input voltage $E_v$ and a resistance $A^2/r_o$ of the parallel resonance circuit $Z_1$.

Second, the active diaphragm 21 can be in a perfectly damped state. More specifically, for a counteraction caused by driving the active diaphragm 21, control is made to overcome the counteraction by increasing/decreasing the drive current.

The passive resonance system constituted by the resonator 10, the passive diaphragm 11 and the fringe portion 12 will be examined below.

As shown in FIG. 1(*b*), the two ends of the series resonance circuit $Z_2$ are also short-circuited with zero ohm in an AC manner. However, in this case, unlike the parallel resonance circuit $Z_1$ described above, the significance of the resonance system is not lost at all. Conversely, the Q value of the resonance system becomes extremely large (if approximate to an ideal state $Q \approx \infty$). Although a driving operation of a virtual acoustic source (speaker) constituted by the resonator 10, the passive diaphragm 11 and the fringe portion 12 is achieved by a displacement (vibration) of the active diaphragm 21 in practice, it is considered for the equivalent circuit that a drive energy is supplied from the drive source $E_v$ in parallel with the vibrator 20. For this reason, by setting the resonance frequency and the resonance Q value in the resonator independently of the vibrator, super-bass reproduction with a sufficient sound pressure can be achieved by a compact system.

Here, since the series resonance circuit $Z_2$ of the passive resonance system is present completely independently of the parallel resonance circuit $Z_1$ of the unit vibration system, the design specifications of the resonator 10 and the passive diaphragm 11 are not influenced by the design specifications of the vibrator 20. Therefore, easy designing free from the mutual dependency condition is allowed.

For the virtual speaker (the acoustic source constituted by the resonator 10, the passive diaphragm 11 and the fringe portion 12), from equations (7) and (8) described above, the current I flowing through the transducer 22 of the vibrator is:

$$\begin{aligned} I &= I_1 + I_2 \\ &= (1/Z_1 + 1/Z_2)E_0 \end{aligned} \tag{9}$$

From equation (8), $Z_2$ value approximates 0 near the resonance frequency $F_{op}$ of the passive diaphragm 11 (in a state wherein the passive resonance system causes resonance) (however, $Z_2$ is damped by a resistance component in practice), and hence, the current $I_2$ can be flowed by a voltage of a very small amplitude.

Since the value corresponding to the lowest resonance frequency $f_o$ of the active diaphragm 21 is higher than the resonance frequency $F_{op}$ of the passive resonance system, the $Z_1$ value is sufficiently large near the resonance frequency $F_{op}$. For this reason, equation (9) can be rewritten as:

$I=I_1+I_2 \approx I_2$ Almost all the current flowing through the transducer 22 contributes to driving of the passive resonance system (virtual speaker). Since the passive resonance system is driven by a small-amplitude voltage (large current), this means that the transducer 22 connected in parallel therewith is also driven by the small-amplitude voltage. Therefore, the active diaphragm 21 performs a small-amplitude operation. In this case, since the active diaphragm 21 performs the small-amplitude operation, a nonlinear distortion which usually occurs in a large-amplitude operation of a dynamic cone speaker can be effectively eliminated in, particularly, a super-bass range.

In the equivalent circuit shown in FIG. 1(*b*), the resonance Q value of the series resonance circuit $Z_2$ which is a series resonance system, unlike the parallel resonance circuit $Z_1$, becomes:

$$Q=(m_p S_c)^{\frac{1}{2}}(1/r_c'+1/r_c'')$$

The Q value of the resonator 10 can be normally controlled easier than the Q value of a speaker unit, and can be adjusted together with resonance frequency $F_{op}$ of the passive resonance system. More specifically, the lowering of the resonance frequency $F_{op}$ of the passive resonance system constituting the resonator 10 can be realized by increasing the equivalent mass $m_p$ of the passive diaphragm 11 in equation (1) described above:

$$f_{op}=(S_c/m_p)^{\frac{1}{2}}/2\pi$$

The lowering of the resonance frequency is readily realized by increasing the mass of the passive diaphragm 11 itself. If, in this case, no increase in the equivalent resistance $r'_c$ and $r''_c$ occurs, then the resonance Q value of the passive resonanc system will apparently increase in accordance with the formula (10). However, the acoustic radiation power seen in terms of sound pressure levels will decrease at a rate of about 6 dB/oct with the decrease of the resonance frequency $f_{op}$, and, thus, such an apparent increase in said value would not be an appreciably remarkable effect from the standpoint of overall judgement.

In addition, there is considered a resonator in which the passive diaphragm is replaced by an equivalent mass constituted by air, the mass corresponding to said passive diaphragm. For example, such a resonator is one in which is used a Helmholtz resonator having an opening duct port such as a bass-reflex type speaker cabinet. It is considered in the above resonator that the opening duct port is modified in dimension and shape to increase the equivalent mass in order to lower the resonance frequency. In this case, however, the port must be narrowed or lengthened thereby necessarily increasing air resistance with an attendant great increase in said equivalent resistance whereby both the Q value and acoustic radiation capability lower at a further greater rate than a case wherein said passive diaphragm is used.

In a case where a resonator is provided with a vibrator for driving the resonator whether it includes a passive diaphragm or not, the internal impedance inherent in the vibrator will necessarily come to be the damping resistance of a resonance circuit as long as the driver constitution for this vibrator is of a usual type (simple voltage driving type), and the value of this damping resistance is far greater as compared with the magnitude of said equivalent resistance, resulting in that the Q value of the resonator is extremely lowered. Accordingly, even if the equivalent mass or the air equivalent mass is attempted to be increased using a conventional apparatus by means of increasing the weight of the passive diaphragm, the acoustic radiation capability will sharply decrease practically to zero in each case whereby these cases do not make remarkable differences therebetween.

According to this invention, in order to drive the vibrator so as to cancel the atmospheric counteraction caused from the resonator side, the aforesaid negative impedance drive or the following motional feedback drive is carried out. In this case, the internal impedance inherent in the vibrator is apparently decreased and will not serve as a damping element even if the resonator is provided with the vibrator. In other words, the active diaphragm of the vibrator has been converted into the wall of the resonator. Thus, the above-mentioned effect of having increased the equivalent mass by increasing the weight of the passive diaphragm, not the air equivalent mass, will almost be realized as the acoustic effect of the acoustic apparatus. This makes it possible to reproduce a resonance sound having acoustic radiation capability extending to an extent of heavy bass range.

Figure 3A:
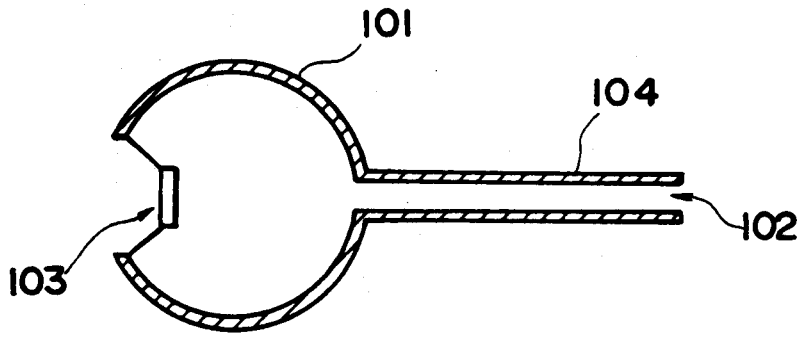
FIGS. 3(*a*) and 3(*b*) are diagrams for explaining problems of the invention of a first prior application filed by the same applicant.
Figure 3B:
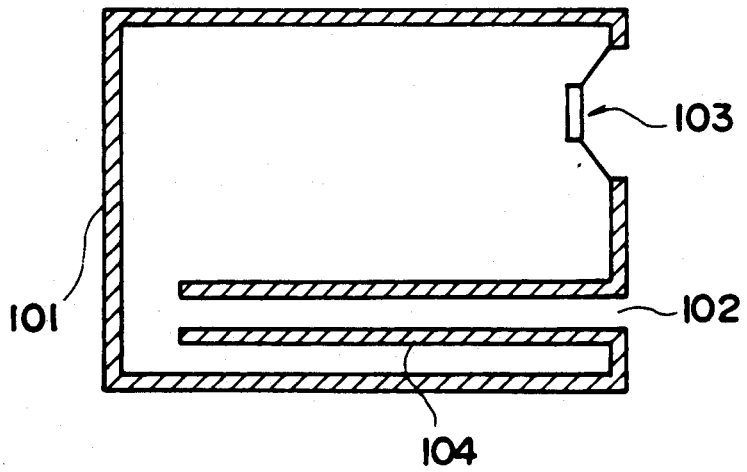

This invention makes it easier to realize super-bass reproduction with satisfactory sound pressure while achieving the miniaturization of a cabinet than the invention of prior Japanese Pat. Appln. No. sho 63-334262 (neither laid open nor published yet) filed by the same applicant. More specifically, according to said prior application, the resonance radiator unit is realized by an opening port 102 formed in a a Helmholtz resonator 101 as indicated in FIGS. 3(*a*) and 3(*b*). Further, a vibrator 103 is designed to be driven by a vibrator drive means generating negative impedance. For this reason, if the resonance frequency is attempted to be lowered in said prior Japanese application, then a duct 104 will have to be lengthened while keeping the cross-sectional area of the opening port 102 at a fixed level, necessarily resulting in that the duct 104 greatly protrudes from the Helmholtz resonator 101 as shown in FIG. 3(*a*) or the duct 104 extends far into the inside of the Helmholtz resonator 101 as indicated in FIG. 3(*b*). This leads to the inevitable use of a large-sized cabinet (especially, the depth of a cabinet being necessarily increased) and is therefore inconsistent with the request that a cabinet can achieve satisfactory super-bass reproduction while it is made in a small size. Since, further, the opening port 102 is inevitably small in area, it is excellent in sound source concentration but it is contrary to the users' general concept that a woofer has a great caliber Thus, such a cabinet may not be fully satisfactory.

According to this invention, lowering of the resonance frequency is achieved by using a large passive diaphragm (that is, increasing the equivalent mass) whereby a cabinet having a remarkably lessened depth may be used and the cabinet may have a desired caliber. Therefore, this invention can overcome the problems raised in the invention of said prior Japanese application.

In the above description of the basic arrangement, the ideal state of $Z_3=Z_v-Z_0=0$ is assumed. However, essentially, the effect of the present invention can be sufficiently obtained if:

$$0<Z_3<Z_v$$

This is because the resonance Q value of the passive resonance system is increased as the $Z_3$ value decreases, and the correlation between the unit vibration system and the passive resonance system gradually disappears as the $Z_3$ value decreases.

It is not preferable that a negative impedance is set too large and the value of $Z_3=Z_v-Z_0$ becomes negative. This is because if $Z_3$ becomes negative, the circuit as a whole including a load has a negative impedance circuit, and causes oscillation Therefore, if the value of the internal impedance $Z_v$ is changed due to heat during operation, the value of the negative impedance must be set with a certain margin or the value of the negative impedance must be changed (temperature-compensated) in accordance with a change in temperature.

Various embodiments which can be applied to the basic arrangement described above with reference to Figs. 1(*a*) and 1(*b*) will be explained below.

The resonator is not limited to one shown in FIG. 1(*a*). For example, the shape of the cavity or body portion is not limited to a sphere but can be a rectangular prism or cube, and the volume of the resonator is not particularly limited.

Various types of vibrator (electroacoustic transducer) such as dynamic type, electromagnetic type, piezoelectric type, and electrostatic type vibrators can be adopted.

Various negative impedance generating means may be used.

Figure 4:
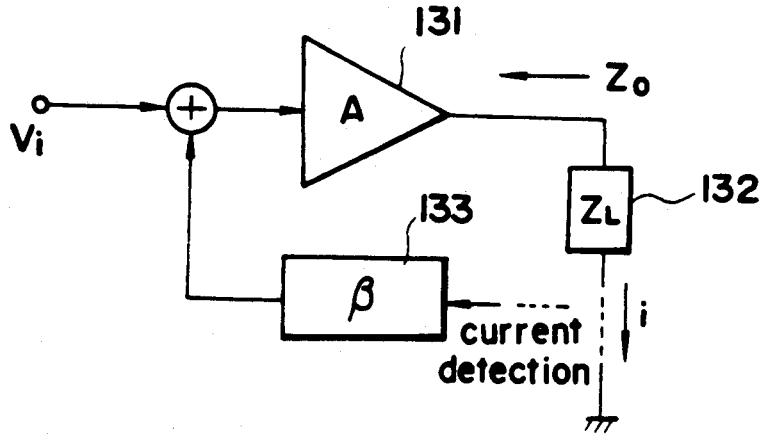
FIG. 4 is a diagram for explaining a basic arrangement of a negative impedance generation.

FIG. 4 shows the basic arrangement of such a means. As shown in the Figure, an output from an amplifier 131 having a gain A is supplied to a load $Z_L$ corresponding to a speaker 132. A current i flowing through the load $Z_L$ is detected, and the detected current is positively fed back to the amplifier 131 through a feedback circuit 133 having a transmission gain $\beta$. With this arrangement, an output impedance $Z_0$ of the circuit is calculated as:

$$Z_0=Z_S(1-A\beta) \quad (11)$$

If $A\beta>1$ is established in equation (11), $Z_0$ becomes an open-circuit stable negative impedance. In equation (11), $Z_S$ is the impedance of a sensor for detecting a current. Note that embodiments corresponding to such circuits are disclosed in Japanese Patent Publication Nos. sho 59-51771 and sho 54-33704.

A concrete example of the first embodiments will be explained below.

Figure 5:
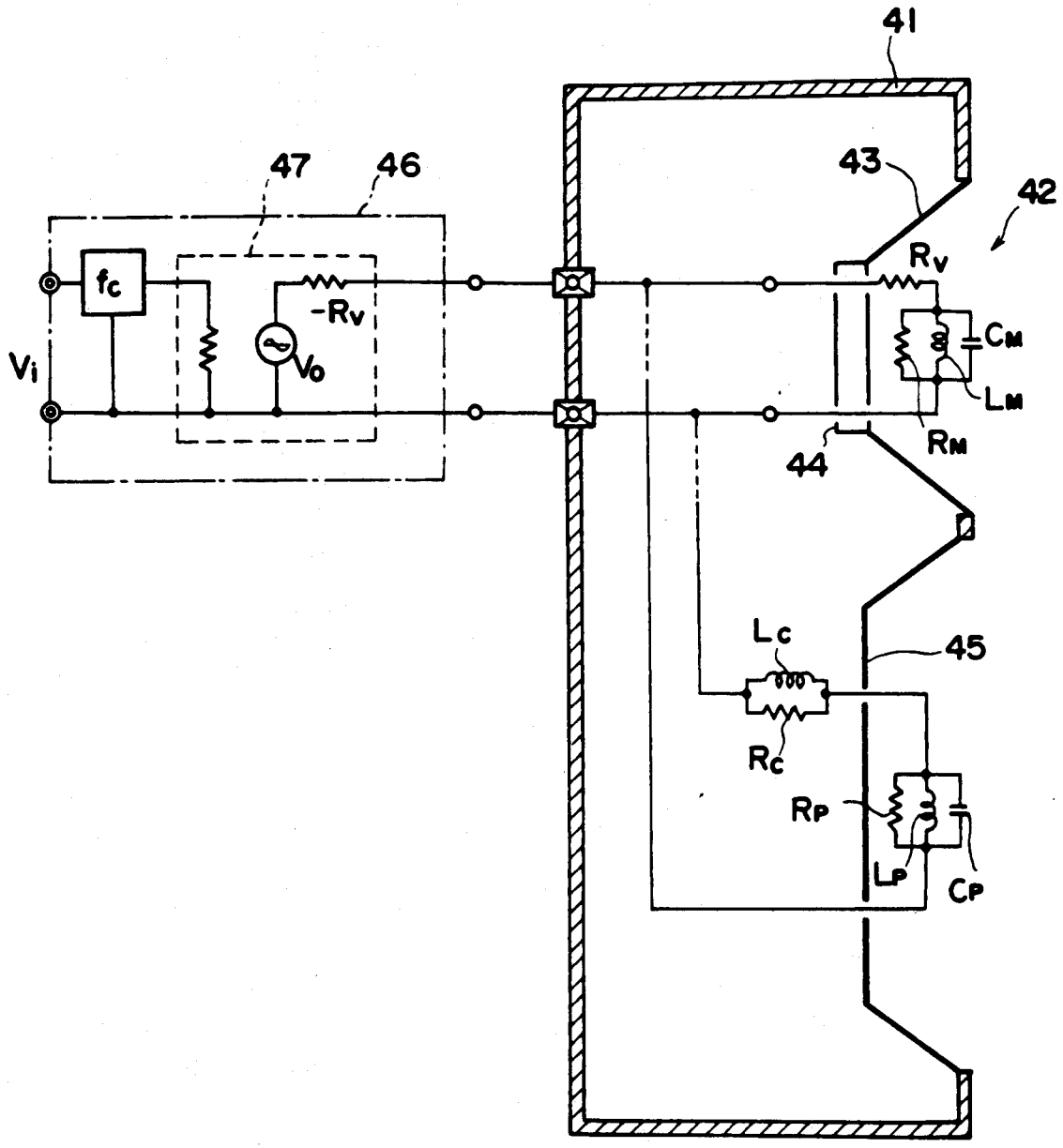
FIG. 5 is a diagram for explaining a concrete example of the first embodiment.

FIG. 5 is a diagram of a concrete example wherein the present invention is applied to a rectangular-prism cabinet. As shown in the Figure, a hole is formed in the front surface of a rectangular-prism cabinet 41, and a dynamic direct radiation speaker 42 is mounted therein. The speaker 42 is constituted by a conical active diaphragm 43, and a dynamic transducer 44 arranged near the top of the cone. A passive diaphragm 45 in the shape of cone is attached below the speaker 42 in the cabinet 41, and constitutes a virtual woofer characterizing the present invention. A driver circuit 46 has a servo circuit 47 for effecting a negative resistance driving, and the dynamic transducer 44 is driven by the output from the servo circuit 47.

The dynamic transducer 44 has a voice coil DC resistance $R_v$ as an inherent internal impedance, while the driver circuit 46 has a equivalent negative resistance component ($-R_v$) in the output impedance. Therefore, the resistance $R_v$ is substantially invalidated. Reference symbols $R_M$, $L_M$ and $C_M$ denote motional impedances obtained when the speaker 42 is electrically equivalently expressed, reference symbols $R_c$ and $L_c$ denote impedances obtained when the cabinet 41 is electrically equivalently expressed, and reference symbols $R_p$, $L_p$ and $C_p$ denote motional impedances obtained when the passive diaphragm 45 is electrically equivalently expressed.

Figure 6:
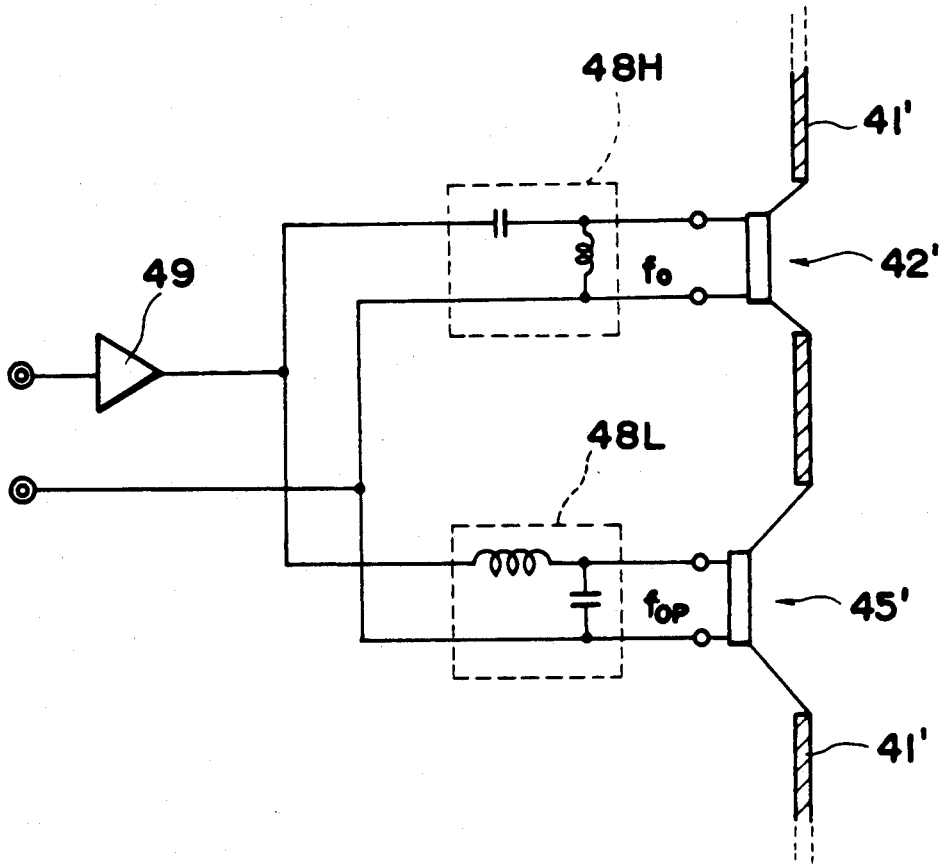
FIG. 6 is a diagram of an arrangement for explaining an equivalent operation of the apparatus shown in FIG. 5.

The arrangement of the equivalent operation of the concrete example shown in FIG. 5 is as shown in FIG. 6. More specifically, a middle/high range speaker 42' formed by the speaker 42 and a virtual woofer 45' equivalently formed by the passive diaphragm 45 are equivalent to a state wherein they are mounted on a closed cabinet 41' having an infinite volume, so that very excellent bass reproduction characteristics can be realized. The middle/high range speaker 42' is connected to a conventional amplifier 49 (which is not subjected to active servo drive) through an equivalently formed high-pass filter (HPF) 48H. The woofer 45' is connected to the amplifier 49 through an equivalently formed low-pass filter (LPF) 48L. (Note that the HPF 48H and LPF 48L are expressed as secondary HPF and LPF, respectively, for the sake of emphasizing a similarity to a conventional network circuit.)

As described above according to this embodiment, since the HPF 48H and the LPF 48L are equivalently formed, the arrangement of the driver circuit can be simplified. For example, in a conventional two-way speaker system, HPF and LPF must be connected to inputs of a tweeter (high range speaker) and a woofer, respectively. Since these filters must have capacitances and inductances, the cost of the driver tends to be increased, and the volume of the filters occupied in the driver circuit tends to be also increased. In addition, their designs must be separately performed. In this invention, since these filters are equivalently formed, these prior art problems can be solved.

Note that sound pressure-frequency characteristics of the vibrator and the resonator as a whole can be arbitrarily set by increasing/decreasing an input signal level to a amplifier. Since both the vibrator and the resonator have sufficient acoustic radiation capabilities, the input signal level need only be adjusted, so that the sound pressure-frequency characteristics of the overall apparatus can be easily realized by wide-range uniform reproduction.

A second embodiment of the present invention will be described hereinafter

Figure 7A:
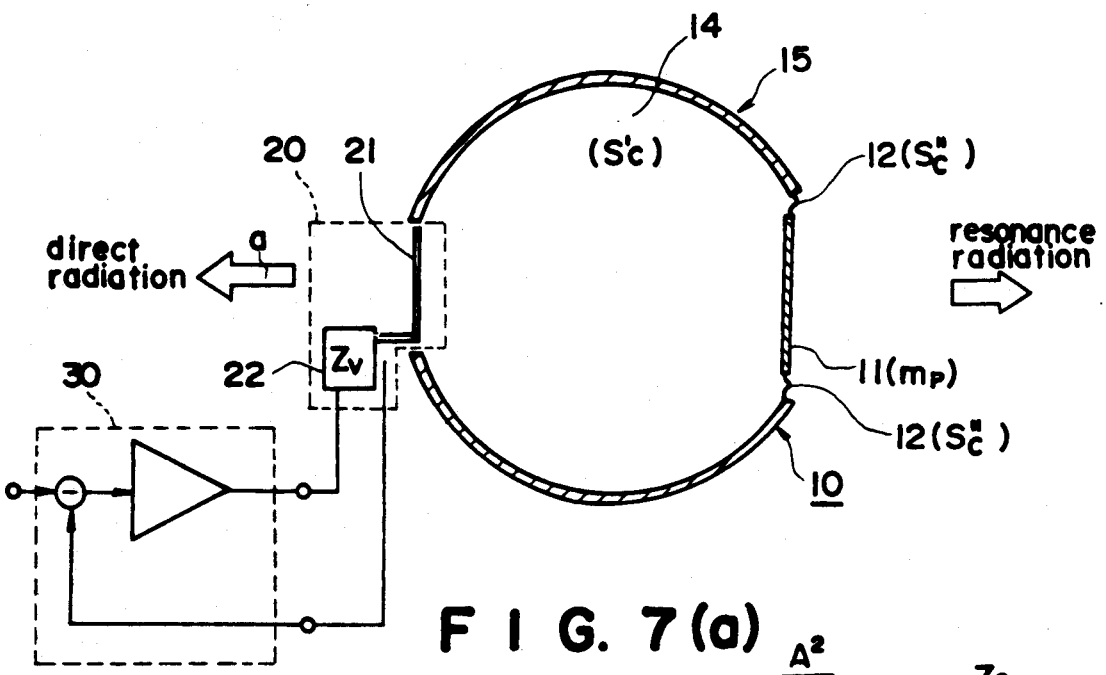
FIGS. 7(*a*) and 7(*b*) are diagrams for explaining a basic arrangement of a second embodiment of the present invention.
Figure 7B:
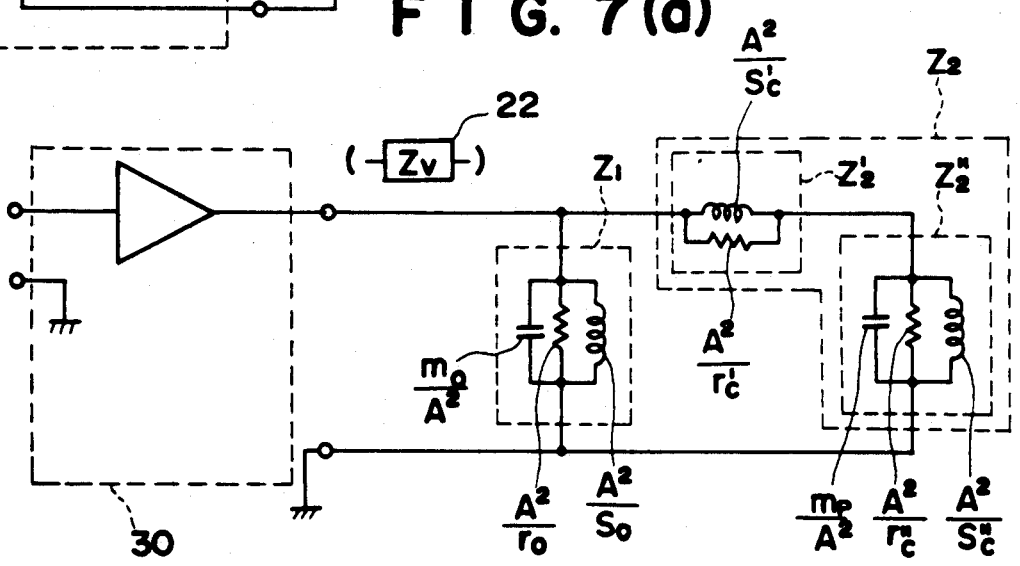

FIG. 7(*a*) shows a basic arrangement concerned. In this embodiment, a vibrator driver 30 comprises a motional feedback (MFB) unit for detecting, by using any appropriate method, motional signal corresponding to movement of the active diaphragm 21 and negatively feeding back the signal to the input side of the driver 30. The constitution of an electric equivalent circuit of the acoustic apparatus, which is shown in FIG. 7(*b*), is quite the same as that of the first embodiment.

Figure 8:
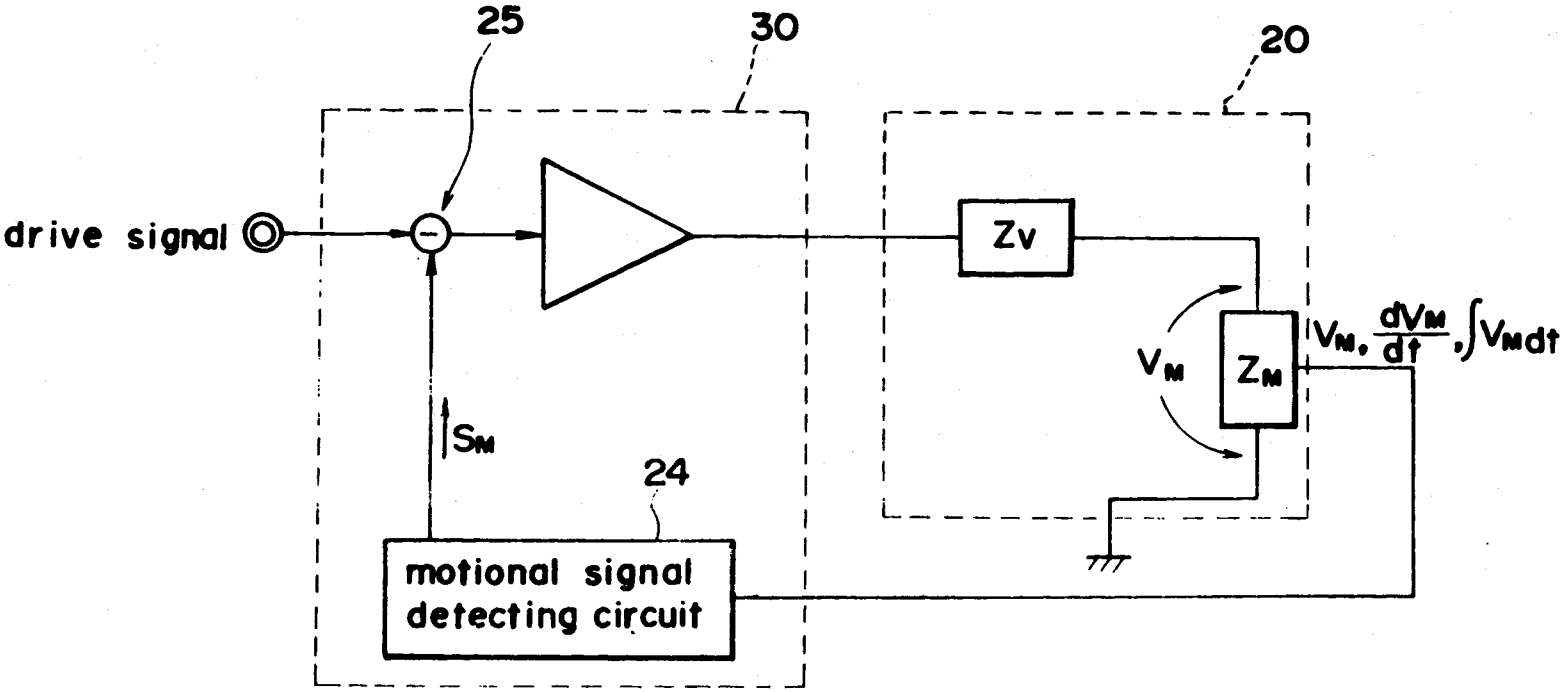
FIG. 8 is a conceptional diagram showing motional feedback function.

As indicated in FIG. 8, the original impedance equivalent circuit of the vibrator 20 is composed of a series circuit wherein said equivalent motional impedance $Z_M$ and the inherent internal impedance $Z_v$ of the transducer 22 are included, as viewed from electric equivalency. The motional signal $S_M$ to be detected from the equivalent motional impedance $Z_M$ includes the voltage across the equivalent motional impedance, the differential output or integral output thereof; these factors so included correspond respectively to the vibration velocity, vibration acceleration and vibration displacement (amplitude) of the active diaphragm 21. The motional feedback constitution or arrangement provided in the vibrator driver 30 has a motional signal detecting unit 24 for detecting as the motional signal an amount corresponding to any one of said factors, and a motional signal $S_M$ so detected is negatively fed back through a feedback unit 25 to the input side of the vibrator driver 30.

The operation of the acoustic apparatus with the arrangement shown in FIG. 7 will be briefly described below.

When a drive signal is supplied from the vibrator driver 30 having a motional feedback function to the transducer 22 of the vibrator 20, the transducer 22 electro-mechanical converts the drive signal so as to reciprocally drive the active diaphragm 21 forward and backward (in the right and left directions in the Figure), the active diaphragm 21 mechano-acoustically converts this reciprocal motion. Since the vibrator driver 30 has a motional feedback unit, if the amount of negative feedback is extremely large, the condition of driving the vibrator driver 30 is brought under follow-up control so that a signal in an amount corresponding to the drive input is always correctly transmitted as the terminal voltage across said equivalent motional impedance, the differential voltage and integral voltage of said terminal voltage. In other words, motional voltages applied to the equivalent motional impedance are controlled so that they correspond to the drive input in a relation of 1:1. Accordingly, the vibrator driver 30 is apparently become equivalent to subjecting the equivalent motional impedance itself of the vibrator 20 directly to linear, integral or differential driving, and the internal impedance inherent in the transducer 22 is effectively invalidated. Therefore, the transducer 22 drives the active diaphragm 21 faithfully in response to the drive signal from the vibrator driver 30, and independently supplies a drive energy to the resonator 10. For this reason, as in the first embodiment, sound pressure-frequency characteristics shown in, e.g., FIG. 2 can be obtained.

The second embodiment of the invention is characteristic of excessive compensation being not caused at all. The motional feedback is follow-up controlled so that a signal in an amount corresponding to the drive input is correctly transmitted to the equivalent motional impedance side, thereby to apparently invalidate the internal impedance. The reduction or invalidation of the internal impedance is realized by detecting a motional signal corresponding to the movement of the diaphragm and putting the drive condition under negative feedback control so that said signal always corresponds to the the drive input, and the magnitude of the internal impedance is reduced to $1/\beta$ when the amount of negative feedback is $\beta$. In other words, the internal impedance is completely cancelled under an ideal condition wherein said $\beta$ is infinitely great, and there cannot, in principle, be caused excessive compensation which exhibits negative impedance as a whole due to cancellations excessively caused. Further, even in a case where the internal impedance varies due to the heat generation of a voice coil or the like, said internal impedance will not greatly vary in the degree of reduction and invalidation thereof if the $\beta$ is great to a certain extent; for this reason, unlike the first embodiment, it is not necessary at all to change the degree of motional feedback (that is, to effect temperature compensation).

In the above explanation, it is assumed that the internal impedance $Z_v$ is completely invalidated ($Z_v=0$) by the motional feedback drive, but, as in the first embodiment mentioned above, sufficient effects of this second embodiment are obtained by effectively reducing $Z_v$.

There are various systems of effecting a motional feedback and of detecting a motional signal.

The fundamental or basic constitution of the motional feedback unit has already been explained with reference to FIG. 8, and it comes to be necessary to detect a motional signal corresponding to the movement of the diaphragm in order to carry out the motional feedback drive. As previously mentioned, the system of detecting the motional signal includes a system of detecting displacement, a system of detecting velocity or a system of detecting acceleration, and the detecting unit has a constitution by which a motional signal is detected in an electric circuit manner from the output of a vibrator driver or from the diaphragm of a vibrator.

The displacement detecting system is such that there is obtained a motional signal in an amount corresponding to the amplitude of a diaphragm, that is, corresponding to the integral output of the voltage across an equivalent motional impedance. The displacement detecting system is exemplified by a capacity-variable MFB speaker. The velocity detecting system is such that there is obtained the velocity of a diaphragm, that is a motional signal in an amount corresponding to the differential output of the voltage across an equivalent motional impedance, and is known as a detection coil type MFB speaker.

The acceleration detecting system is such that there is obtained a motional signal in an amount corresponding to the acceleration of a diaphragm, that is, an amount corresponding to the voltage across an equivalent motional impedance itself, and is known as a piezo-electric MFB loudspeaker.

The amplitude-corresponding, velocity-corresponding and acceleration-corresponding motional signals detected as mentioned above may be converted to one another by the use of a differential circuit or integral circuit. Therefore, irrespective of the fact that which one of the three detecting systems is used, signals corresponding to amplitude, velocity and acceleration can be fed back singly or in suitable combination.

Figure 9:
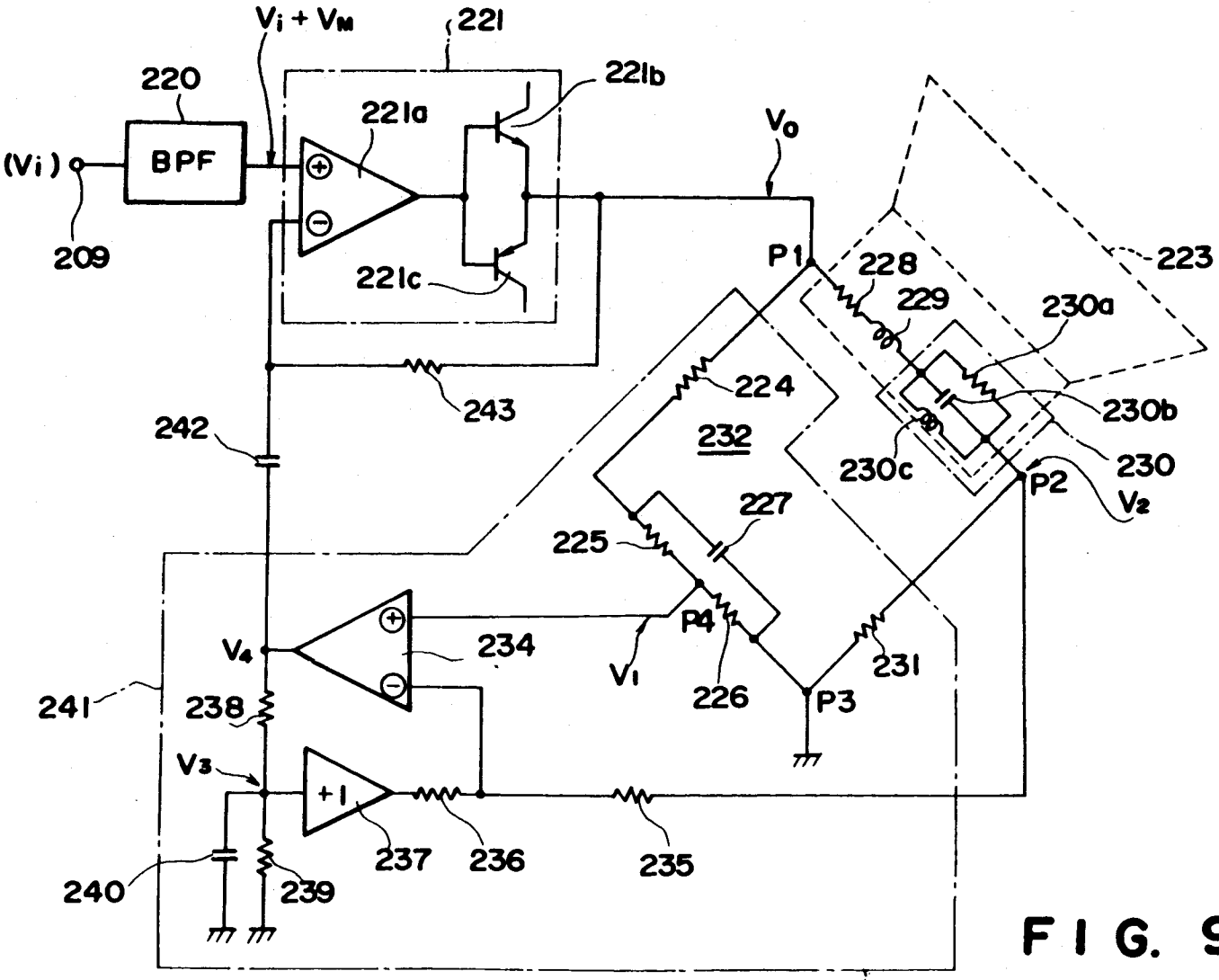
FIG. 9 is a diagram showing a motional feedback circuit using a bridge detection circuit.

Referring now to FIG. 9, there will be explained an example of bridge-type motional feedback as a system which detects the motional signal by the electrically constituted detecting means and negatively feeds it back.

FIG. 9 is a circuit concerned. In this Figure, a band pass filter (BPF) circuit 220 allows a signal $V_i$ to be inputted thereto from an input terminal 209 and outputs a signal $(V_i+V_M)$. This circuit enables the voltage wave form of the input signal $V_i$ to be accurately transmitted to between both the ends of the motional impedance of the speaker 223.

An amplifier unit 221 is composed of a voltage amplifier 221*a* having a large open-loop-gain, and transistors 221*b* and 221*c* which compose a capability stage. The output terminal of the amplifier unit 221 is connected to one terminal of the speaker 223, and one surface of the diaphragm of the speaker 223 serves as a direct radiator portion for radiating acoustic waves directly to the outside, while the other surface serves as a resonator driver portion. Along by this driver portion, a resonator (not shown) having a passive diaphragm is provided.

The speaker 223, resistors 224 to 226 and 231, and capacitor 227 together constitute a bridge circuit 232 for detecting the motional voltage $V_M$. The combined resistance of the resistors 224 to 226 within the bridge circuit 232, represented by $(\alpha\cdot R_v+\alpha\cdot R_s/2+\alpha\cdot R_s/2)$, is set to be sufficiently larger than that $(R_v+R_s)$ of the resistors 228 and 231, and the resistance $R_s$ of resistor 231 is set to be sufficiently smaller than the resistance $R_v$ of the resistor 28. Meanwhile, the resistors 224, 225, 226 and 231 are set to have relationship with the speaker 223 as indicated in the following equation:

$$(\alpha\cdot R_v)/(\alpha\cdot R_s)=R_v/R_s \qquad (12)$$

By determining the resistance of resistors as described above, it becomes possible to accurately detect the motional voltage $V_M$ between a connection point P4 where the resistors 225 and 226 are connected together and another connection point P2 where the resistor 231 and the other terminal of the speaker 223 are connected together.

The bridge circuit 232, the amplifiers 234 and 237, the resistors 235, 236, 238 and 239, and the capacitor 240 together constitute a bridge amplifier unit 241. This bridge amplifier unit 241 corresponds to a detecting means for detecting motional voltage applied to the equivalent motional impedance and outputting a motional signal.

In this manner, the motional voltage $V_M$ of the speaker 223 can be obtained from the output voltage $V_4$ of the bridge amplifier 234 with accuracy.

Next, description will be given with respect to the operation of the circuit of FIG. 9.

First, by the BPF circuit 220, the signal level of predetermined frequency components of the input signal $V_i$ is raised. More specifically, the internal impedance inherent in the speaker 223 is apparently invalidated due to the motional feedback drive being effected, resulting in that the speaker 223 behaves in such a manner as $Q\approx 0$ thereby to lower the sound pressure characteristic at the value neighborhood corresponding to the lowest resonance frequency $f_o$; to compensate for said lowering, the signal level in the pertinent frequency band is raised. This signal $(V_i+V_M)$ is amplified by the amplifier 221*a* within the amplifier unit 221. Then, the amplified signal is supplied to the speaker 223, whereby the speaker 223 will be driven to exhibit approximately flat sound pressure characteristics.

At this time, the motional voltage $V_M$ is produced between both the terminals of the equivalent circuit 230 of the speaker 223. The motional voltage $V_M$ is detected by the bridge amplifier unit 241, and the detected motional voltage $V_M$ is supplied to the inverting input terminal of the amplifier 221a via the capacitor 242. Since a capacitor 227 corresponding to the internal inductance of the speaker 223 is provided in the detection bridge, the motional voltage is far more correctly detected by this detection bridge than by a conventional one, whereby the motional voltage $V_M$ is correctly fed back in an extremely large amount of feedback to the amplifier unit 221.

Since in this manner the motional voltage $V_M$ is made to be negatively fed back in an extremely large amount to the amplifier unit 221, the internal impedance ($R_v$, $L_v$) is almost completely invalidated whereby the speaker 223 faithfully responds to drive inputs and radiate acoustic waves entirely without including distortions caused by the transient response of the vibration system. Further, since the drive input level is additionally controlled, the same flat sound pressure-frequency characteristics as conventional can finally be realized and, further, said characteristics can be extended to a lower region depending on the contents of said drive input level control.

In addition to this, the vibration system of the speaker 223 does substantially not serve as a resonance system, and the diaphragm of the speaker 223 becomes equivalent to the wall surface of a resonator (not shown) resulting in that energy is supplied to this resonance system independently of the vibration system of the speaker 223. In addition, since the internal impedance is apparently invalidated, the Q value of the resonator will not decrease at all even if the speaker 223 is provided along by the resonator, resulting in that the acoustic wave radiation capability of said resonator is sufficiently enhanced.

Methods for detecting motional signals are not limited to those mentioned and various modified one are useful.

First of all, methods for optical detection are known from Japanese Utility Model Publications Nos. sho 42-5561 and sho 42-15110 as well as from Japanese Utility Model Publication No. sho 43-12619 in which the use of modulation by slits is disclosed and Japanese Patent Publication No. sho 54-111327 in which the use of photofibers is disclosed.

Detection using semiconductors can be carried out, for example, by inserting a magnetism-sensitive semiconductor element (Japanese Utility Model Publication No. sho 44-28472) or by providing a hall element in front of the pole piece of a speaker (Japanese Pat. Appln. Laid-Open No. sho 49-102324).

Detection using piezo-electric effects can be carried out, for example, by providing a piezo-electric element in front of the cone paper of a cone speaker (Japanese Utility Model Publication No. sho 41-20247).

Further, electrostatic detection of the amplitude of a diaphragm is carried out by, for example, providing a bobbin movable electrode between an internal fixed electrode and an external fixed electrode (Japanese Patent Publication No. sho 54-36486).

On the other hand, detection of motional signals by the use of electrical constitution is achieved by carrying out bridge detection by using a differential amplifying circuit (Japanese Utility Model Publication No. sho 44-9634) or by using a center-tapped output transformer as a component element of a bridge circuit (Japanese Utility Model Publication No. sho 43-2502).

A concrete example of the second embodiment will be explained below.

Figure 10:
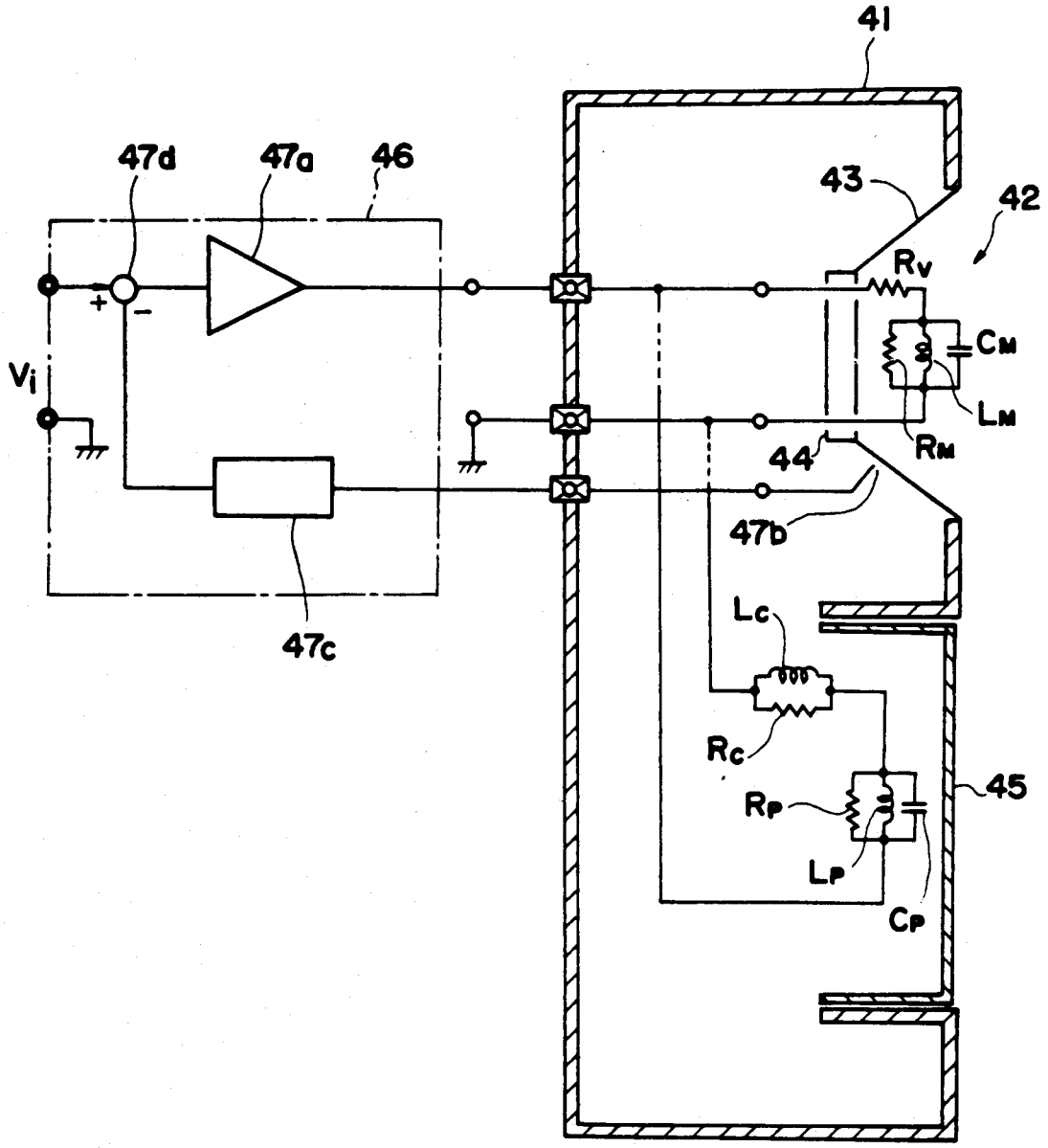
FIG. 10 is a diagram showing a concrete example of the second embodiment.

FIG. 10 is a diagram of arrangement of a concrete example wherein the present invention is applied to a rectangular-prism cabinet. As shown in the Figure, a passive diaphragm in a shape of flat plate is disposed, in a manner that it can be movable forwards and backwards, below a dynamic direct radiation speaker 42 attached to the front surface of a rectangular-prism cabinet 41, and constitutes a virtual woofer characterizing the present invention. A driver circuit 46 has a driver unit 47a having a large-open-loop gain, a detecting unit 47b for detecting the motional voltage applied to the equivalent motional impedance of the dynamic transducer 44, a feedback unit 47c for effecting a predetermined conversion on the output of the detecting unit 47b, and a subtracter 47d for negatively feeding back the motional signal outputted from the feedback unit 47c. The dynamic transducer 44 is driven by the output of the driver circuit 46.

The dynamic transducer 44 has a voice coil DC resistance $R_v$ as an inherent internal impedance, which can be apparently invalidated by the feedback driving of the driver circuit 46.

With this arrangement, a middle/high range speaker formed by the speaker 42 and a virtual woofer equivalently formed by the passive diaphragm 45 are equivalent to a state wherein they are mounted on a closed cabinet having an infinite volume. The middle/high range speaker is connected to a conventional amplifier (which is not subjected to active servo drive) through an equivalently formed high-pass filter (HPF). The woofer is connected to the amplifier through an equivalently formed low-pass filter (LPF).

In this example, sound pressure-frequency characteristics of the vibrator and the resonator as a whole can be arbitrarily set by increasing/decreasing an input signal level to an amplifier. Since both the vibrator and the resonator have sufficient acoustic radiation capabilities, the input signal level need only be adjusted, so that the sound pressure-frequency characteristics of the overall apparatus can be easily realized by wide-range uniform reproduction. In the circuit shown in FIG. 9, such adjusting is realized e.g. by the BPF circuit 220.

Effect of the First Aspect of This Invention

With the above arrangement, the resonator is driven by the resonator driver portion of the active diaphragm whereby an acoustic wave is directly radiated outwards from the direct radiator portion of the active diaphragm, and an acoustic wave caused by resonance is radiated outwards from the passive diaphragm serving as the resonance radiation unit of the resonator.

The vibrator has an inherent internal impedance, and the vibrator drive means for driving the vibrator has a drive control means for controlling the drive condition so as to cancel the atmospheric counteraction of the resonator at the time of driving of the resonator by the vibrator. Therefore, when the vibrator drive means comprises a means for equivalently generating a negative impedance component in the output impedance or when the vibrator drive means comprises a motional feedback means for detecting a motional signal corresponding to vibration deviation, velocity or acceleration of the motional impedance of the vibrator and negatively feeding back said motional signal to the input side of said vibrator drive means, said internal impedance inherent in the vibrator can be apparently reduced.

For this reason, the vibrator becomes an element responsive to only an electrical drive signal input, and does not function as a resonance system. At the same time, the volume of the resonator is no longer a factor which influences low-frequency reproduction capabilities of the vibrator. Thus, if the cabinet made compact in size is used, bass reproduction without including distortion due to a transient response of the vibrator can be realized at the vibrator side. In addition, the resonance frequency of the resonator can be easily lowered by increasing the equivalent mass of the passive diaphragm, and a decrease in acoustic radiation capabilities which is caused by increasing the equivalent mass of the passive diaphragm can be slight as compared with such a decrease which is caused by increasing an air equivalent mass. This enable a miniaturized (especially thinned) cabinet to be used and its caliber to be optionally designed.

As shown in the mechanical or electric equivalent circuit, since an vibration system constituted by the vibrator and a resonance system constituted by the resonator can be dealt with independently as much as possible (preferably, completely independently), the mutual dependency between the above systems on design can be eliminated (or preferably, removed) without causing any problem. Thus, designing can be much facilitated.

As described above, the compact size and super-bass (heavy bass) reproduction can be simultaneously achieved, and designing can be facilitated.

The acoustic apparatus of the present invention can be widely applied to sound sources of electronic or electric musical instruments, and the like as well as audio speaker systems.

Embodiments in a second aspect of the present invention will be described hereinafter.

Figure 11A:
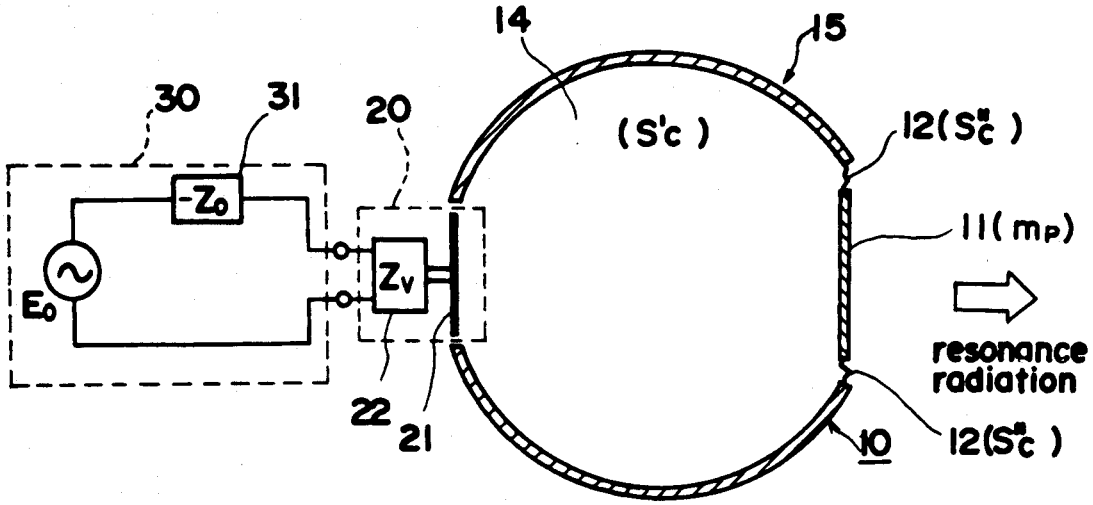
FIGS. 11(*a*) and 11(*b*) are diagrams for explaining a basic arrangement of a third embodiment of the present invention.
Figure 11B:
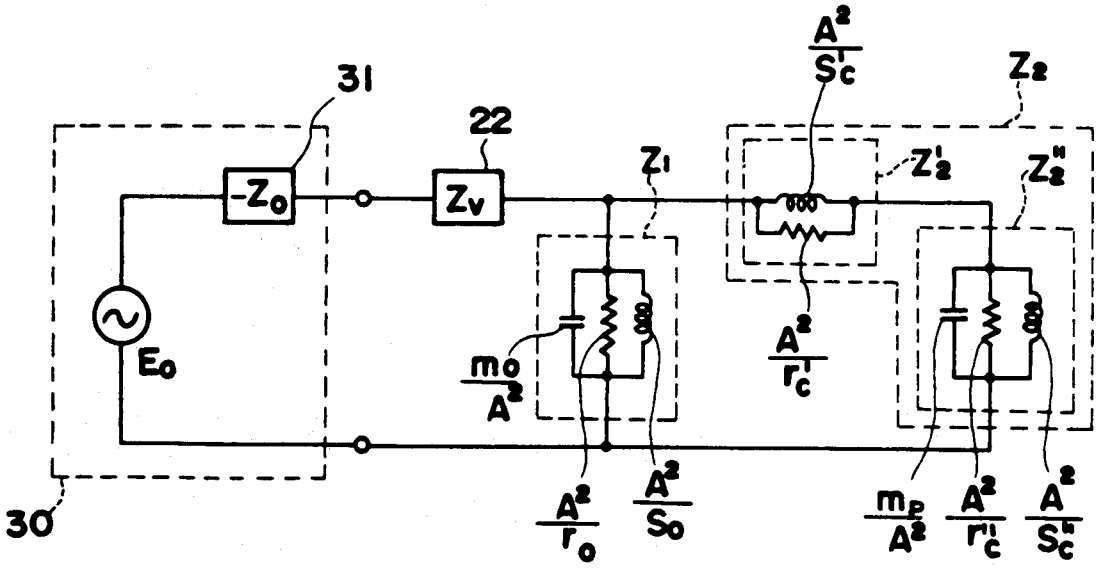

FIGS. 11(*a*) and 11(*b*) show a basic arrangement of a third embodiment of the present invention. As shown in Fig. 11(*a*), in this embodiment, a resonator 10 having a passive diaphragm 11 serving as a resonance radiation unit is used. In the resonator 10, a resonance phenomenon is caused by a closed cavity (hollow drum) 14 formed in a body portion 15 and the passive diaphragm 11 attached to the body portion 15 with the fringe portion 12. The resonance frequency $F_{op}$ is given by equation (1) as described above.

$$f_{op}=(S_c/m_p)^{\frac{1}{2}}2\pi \quad (1)$$

where $S_c$ total of the stiffness $S_c'$ of the cavity 14 and the stiffness $S_c''$ of the fringe portion 12;

$(S_c+S_c'')$ $m_p$: equivalent mass of the passive diaphragm 11

In the acoustic apparatus of this embodiment, a vibrator 20 constituted by an active diaphragm 21 and a transducer 22 is attached to the body portion 15 of the resonator 10. The transducer 22 is connected to a vibrator driver 30, which comprises a negative impedance generator unit 31 for equivalently generating a negative impedance component $(-Z_0)$ in the output impedance.

The constitution of the acoustic apparatus indicated in FIG. 11(*a*) is quite the same as that indicated in FIG. 1(*a*) except that the former is lacking in a portion corresponding to the direct radiator portion of the active diaphragm 21. In this embodiment, although not particularly shown, said portion corresponding to the direct radiator portion constitutes a second resonance driver portion like the back face of the diaphragm of the speaker of the conventional apparatus mentioned above as the fifth prior art or is tightly closed by a cabinet like the back face of the diaphragm of the first speaker of the conventional apparatus mentioned above as the sixth prior art.

FIG. 11(*b*) shows the electric equivalent circuit of the acoustic apparatus of FIG. 11(*a*). The circuit is the same as that of FIG. 1(*b*).

The operation of the acoustic apparatus with the arrangement shown in FIG. 11(*a*) will be briefly described below.

When a drive signal is supplied from the vibrator driver 30 having a negative impedance drive function to the transducer 22 of the vibrator 20, the transducer 22 electric-mechanical converts the drive signal so as to reciprocally drive the active diaphragm 21 forward and backward (in the right and left directions in the Figure). Since the vibrator driver 30 has the negative impedance drive function, the internal impedance inherent in the transducer 22 is effectively decreased (ideally invalidated). Therefore, the transducer 22 drives the active diaphragm 21 faithfully in response to the drive signal from the vibrator driver 30, and independently supplies a drive energy to the resonator 10.

At this time, the front surface side (the right surface side in the Figure) of the active diaphragm 21 receives an atmospheric counteraction from air in the cavity of the resonator 10, and the vibrator driver 30 drives the vibrator 20 so as to cancel the counteraction. This is because the internal impedance $Z_v$ inherent in the transducer 22 of the vibrator 20 is equivalently invalidated. Hence, the active diaphragm 21 becomes an equivalent wall of the resonator 10, and the resonance Q value ideally becomes infinite. For this reason, air in the resonator 10, and the passive diaphragm 11 and the fringe portion 12 are resonated, so that an acoustic wave having a sufficient sound pressure is radiated from the passive diaphragm serving as the resonance radiation unit.

Figure 12:
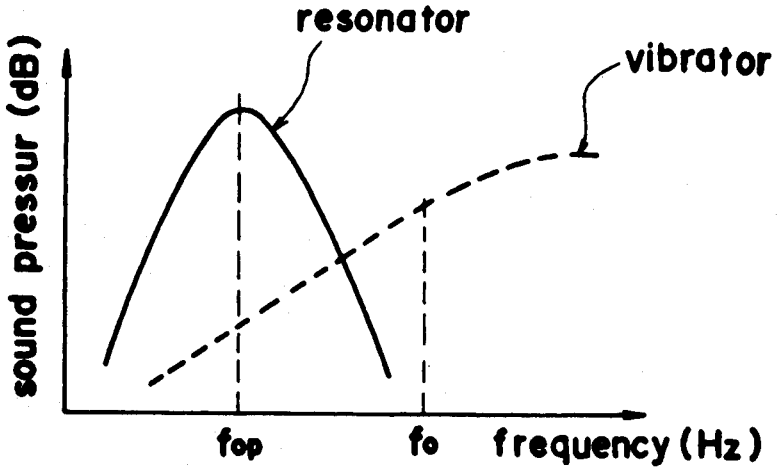
FIG. 12 is a graph showing sound pressure-frequency characteristics of the apparatus shown in FIG. 11(*a*)

By adjusting an equivalent mass of the passive diaphragm 11 and an equivalent stiffness of the fringe portion 12, especially by adjusting said equivalent mass, the resonance frequency $F_{op}$ is set in a predetermined frequency range, and the resonance Q value is set to be an appropriate level, sound pressure-frequency characteristics shown in, e.g., FIG. 12 can be obtained. Note that a dotted characteristic curve in the Figure represents an example of frequency characteristics of the vibrator itself.

The electric equivalent circuit of FIG. 11(*b*) is quite identical with that shown in FIG. 1(*b*) of the acoustic apparatus of said first embodiment and, therefore, quite the same explanation may apply to the latter. For example, a parallel resonance circuit $Z_1$ consisting of the equivalent motional impedance of the vibrator 20 and a series resonance circuit $Z_2$ consisting of the equivalent motional impedance of the resonator 10 are respectively short-circuited with zero impedance in an AC (alternate current) manner. As a result, the parallel resonance circuit $Z_1$ and the series resonance circuit $Z_2$ become to be present as resonance systems independently of each other. Therefore, if the resonator 10 is designed to be compact in order to reduce the size of the system, or when the passive diaphragm 11 is designed to be enlarged in order to lower the resonance frequency of the passive resonance system, the design of the unit vibration system is not influenced at all, and the value corresponding to the lowest resonance frequency $f_o$ is not influenced at all, either. For this reason, easy designing of a vibrator and a resonator free from the mutual dependency condition is allowed.

Further, the parallel resonance circuit $Z_1$ comes under a condition of $Q=0$ and does not substantially resonate, while the series resonance circuit $Z_2$ comes under a condition of $Q \approx \infty$ and exhibits an extremely high capability of resonance and radiation. In addition, since the two circuits come under a condition of $Z_1 >> Z_2$ in the neighborhood of resonance frequency $f_{op}$, the resonator 10 is driven by a large current and a small-amplitude voltage. Therefore, the transducer 22 connected in parallel therewith is also driven by the small-amplitude voltage, and hence, the active diaphragm 21 performs a small-amplitude operation. In this case, since the active diaphragm 21 performs the small-amplitude operation, a nonlinear distortion which usually occurs in a large-amplitude operation of a dynamic cone speaker can be effectively eliminated in, particularly, a super-bass range.

It is easy to controllably lower too great Q, that is the excessively high resonance and radiation capability. Such a control is achieved even by, for example, increasing the weight of the passive diaphragm 11 itself for increasing the equivalent mass $m_p$ of the passive diaphragm 11.

If, in this case, no increase in the equivalent resistance $r'_c$ and $r''_c$ occurs, then the resonance Q value of the passive resonance system will apparently increase in accordance with the formula (10). However, the acoustic radiation power seen in terms of sound pressure levels will decrease at a rate of about 6 dB/oct with the decrease of the resonance frequency $f_{op}$, and, thus, such an apparent increase in said value would not be an appreciably remarkable effect from the standpoint of overall judgement.

In addition, there is considered a resonator in which the passive diaphragm is replaced by an equivalent mass constituted by air, the mass corresponding to said passive diaphragm. For example, such a resonator is one in which is used a Helmholtz resonator having an opening duct port such as a bass-reflex type speaker cabinet. It is considered in the above resonator that the opening duct port is modified in dimension and shape to increase the equivalent mass in order to lower the resonance frequency. In this case, however, the port must be narrowed or lengthened thereby necessarily increasing air resistance with an attendant great increase in said equivalent resistance whereby both the Q value and acoustic radiation capability lower at a further greater rate than a case wherein said passive diaphragm is used.

In a case where a resonator is provided with a vibrator for driving the resonator whether it includes a passive diaphragm or not, the internal impedance inherent in the vibrator will necessarily come to be the damping resistance of a resonance circuit as long as the driver constitution for this vibrator is of a usual type (simple voltage driving type), and the value of this damping resistance is far great as compared with the magnitude of said equivalent resistance, resulting in that the Q value of the resonator is extremely lowered. Accordingly, even if the equivalent mass or the air equivalent mass is attempted to be increased using a conventional apparatus by means of increasing the weight of the passive diaphragm, the acoustic radiation capability will sharply decrease practically to zero in each case whereby these cases do not make remarkable differences therebetween.

According to this invention, in order to drive the vibrator so as to cancel the atmospheric counteraction caused from the resonator side, the aforesaid negative impedance drive or the following motional feedback drive is carried out. In this case, the internal impedance inherent in the vibrator is apparently decreased and will not serve as a damping element even if the resonator is provided with the vibrator. In other words, the active diaphragm of the vibrator has been converted into the wall of the resonator. Thus, the above-mentioned effect of having increased the equivalent mass by increasing the weight of the passive diaphragm, not the air equivalent mass, will almost be realized as the acoustic effect of the acoustic apparatus. This makes it possible to reproduce a resonance sound having acoustic radiation capability extending to an extent of heavy bass range.

Figure 13A:
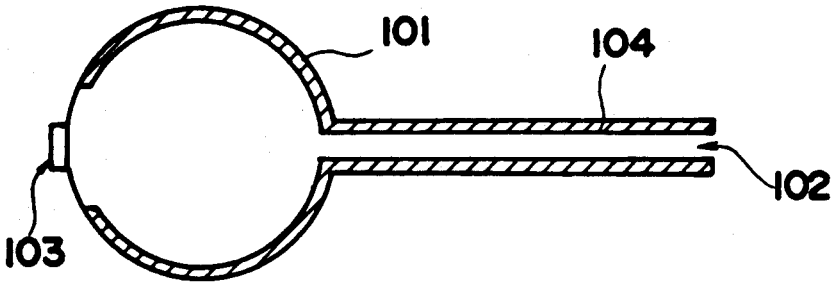
FIGS. 13(*a*) and 13(*b*) are diagrams for explaining problems of the invention of a second prior application filed by the same applicant.
Figure 13B:
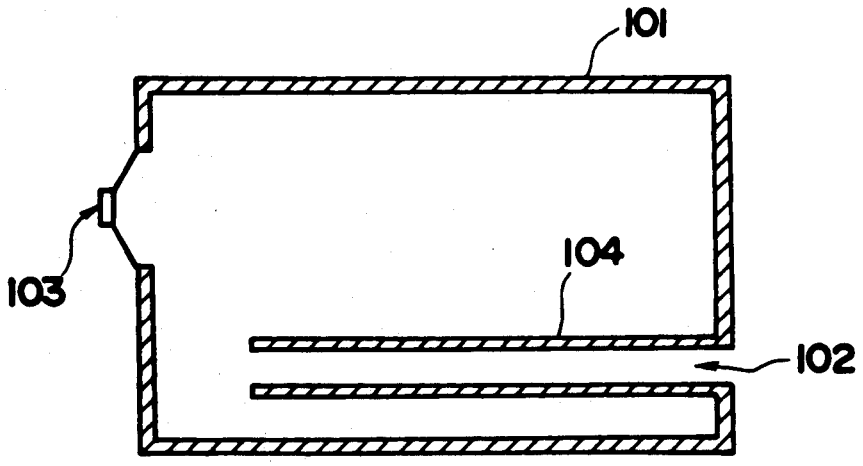

This invention makes it easier to realize satisfactory resonance sound radiation performances while achieving the miniaturization of a cabinet than the invention of prior Japanese Pat. Appln. No. sho 62-334263 (neither laid open nor published yet) filed by the same applicant. More specifically, according to said prior application, the resonance radiator unit is realized by an opening port 102 formed in a a Helmholtz resonator 101 as indicated in FIGS. 13(*a*) and 13(*b*). Further, a vibrator 103 is designed to be driven by a vibrator drive means generating negative impedance. For this reason, if the resonance frequency is attempted to be lowered in said prior Japanese application, then a duct 104 will have to be lengthened while keeping the cross-sectional area of the opening port 102 at a fixed level, necessarily resulting in that the duct 104 greatly protrudes from the Helmholtz resonator 101 as shown in FIG. 13(*a*) or the duct 104 extends far into the inside of the Helmholtz resonator 101 as indicated in FIG. 13(*b*). This leads to the inevitable use of a large-sized cabinet (especially, the depth of a cabinet being necessarily increased) and is therefore inconsistent with the request that a cabinet can achieve satisfactory acoustic radiation performances while it is made in a small size. Since, further, the opening port 102 is inevitably small in area, it is excellent in sound source concentration but it is contrary to the users' general concept that a woofer has a great caliber. Thus, such a cabinet may not be fully satisfactory.

According to this invention, lowering of the resonance frequency is achieved by using a large passive diaphragm (that is, increasing the equivalent mass) whereby a cabinet having a remarkably lessened depth may be used and the cabinet may have a desired caliber. Therefore, this invention can overcome the problems raised in the invention of said prior Japanese application.

In addition, even in a case where the internal impedance $Z_v$ is not completely invalidated ($Z_v=0$) but suitably reduced, there will be obtained effects corresponding to the degree of the reduction, this being the same as in the first embodiment.

Further, the shape of the cavity portion may be, for example, spheric, rectangular in section or cubic. The vibrators which may be used include dynamic type, electromagnetic type, piezoelectric type, and electrostatic type vibrators.

A concrete example of the third embodiment will be explained below.

Figure 14:
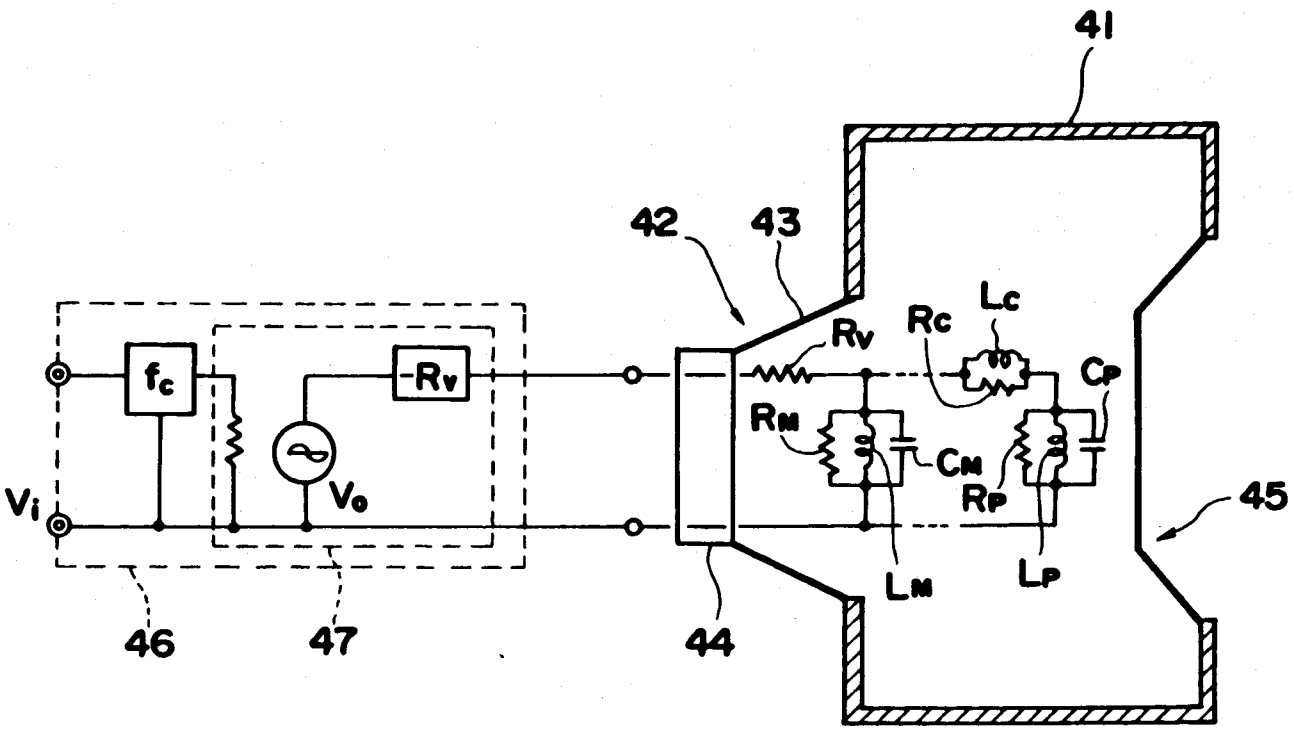
FIG. 14 is a diagram for explaining a concrete example of the third embodiment.

FIG. 14 is a diagram of a concrete example wherein the present invention is applied to a rectangular-prism cabinet. As shown in the Figure, a hole is formed in the rear surface of a rectangular-prism cabinet 41, and a dynamic direct radiation speaker 42 is mounted therein. The speaker 42 is constituted by a conical active diaphragm 43, and a dynamic transducer 44 arranged near the top of the cone. A passive diaphragm 45 in the shape of cone is mounted on the front surface of the cabinet 41, and constitutes a virtual woofer characterizing the present invention. A driver circuit 46 has a servo circuit 47 for effecting a negative resistance driving, and the dynamic transducer 44 is driven by the output from the servo circuit 47.

The dynamic transducer 44 has a voice coil DC resistance $R_v$ as an inherent internal impedance, while the driver circuit 46 has an equivalent negative resistance component $(-R_v)$ in the output impedance, so that the resistance $R_v$ can be substantially invalidated by the negative resistance component. Reference symbols $R_M$, $L_M$ and $C_M$ denote motional impedances obtained when the speaker 42 is electrically equivalently expressed, reference symbols $R_c$ and $L_c$ denote impedances obtained when the cabinet 41 is electrically equivalently expressed, and reference symbols $R_p$, $L_p$ and $C_p$ denote motional impedances obtained when the passive diaphragm 45 is electrically equivalently expressed.

Figure 15:
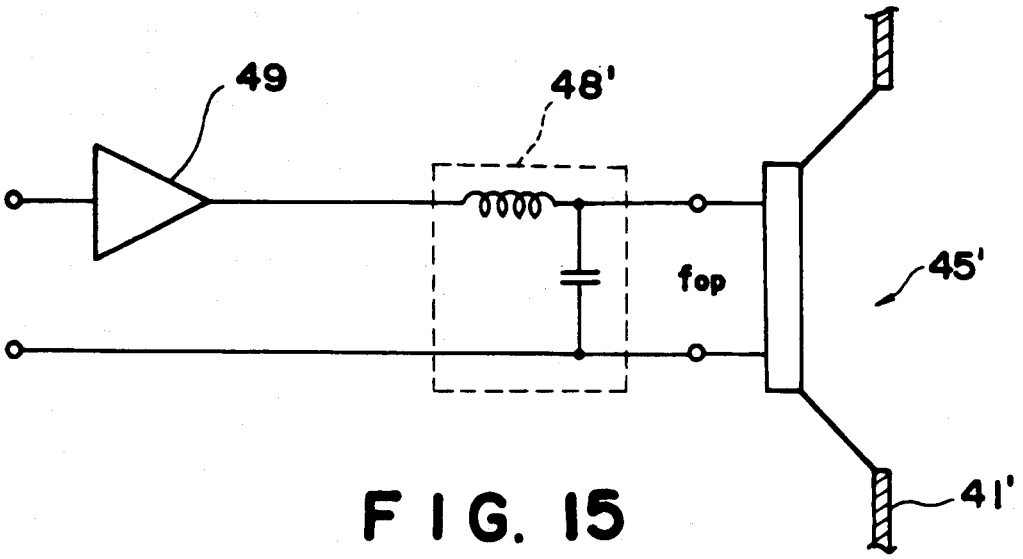
FIG. 15 is a diagram of an arrangement for explaining an equivalent operation of the apparatus shown in FIG. 14.
Figure 16:
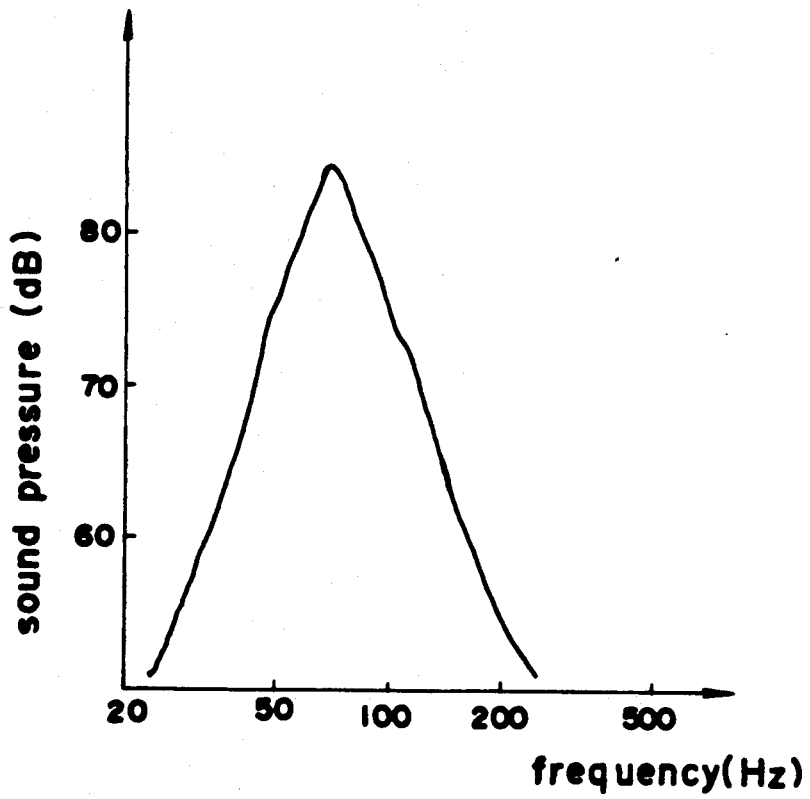
FIG. 16 is a graph showing sound pressure-frequency characteristics of the apparatus shown in FIGS. 14 and 15.

The arrangement of the equivalent operation of the example shown in FIG. 14 is as shown in FIG. 15. More specifically, a virtual speaker 45' equivalently formed by the passive diaphragm 45 is equivalent to a state wherein it is mounted on a closed cabinet 41' having an infinite volume. The speaker 45' is connected to a conventional amplifier 49 (which is not subjected to active servo drive) through an equivalently formed low-pass filter (LPF) 48. Note that sound pressure-frequency characteristics of the sound wave radiated from the passive diaphragm 45 can be controlled not only by adjusting its equivalent mass but also by increasing/decreasing the input signal level of the amplifier. For example, an acoustic wave radiation having a frequency dependency shown in FIG. 16.

Figure 17:
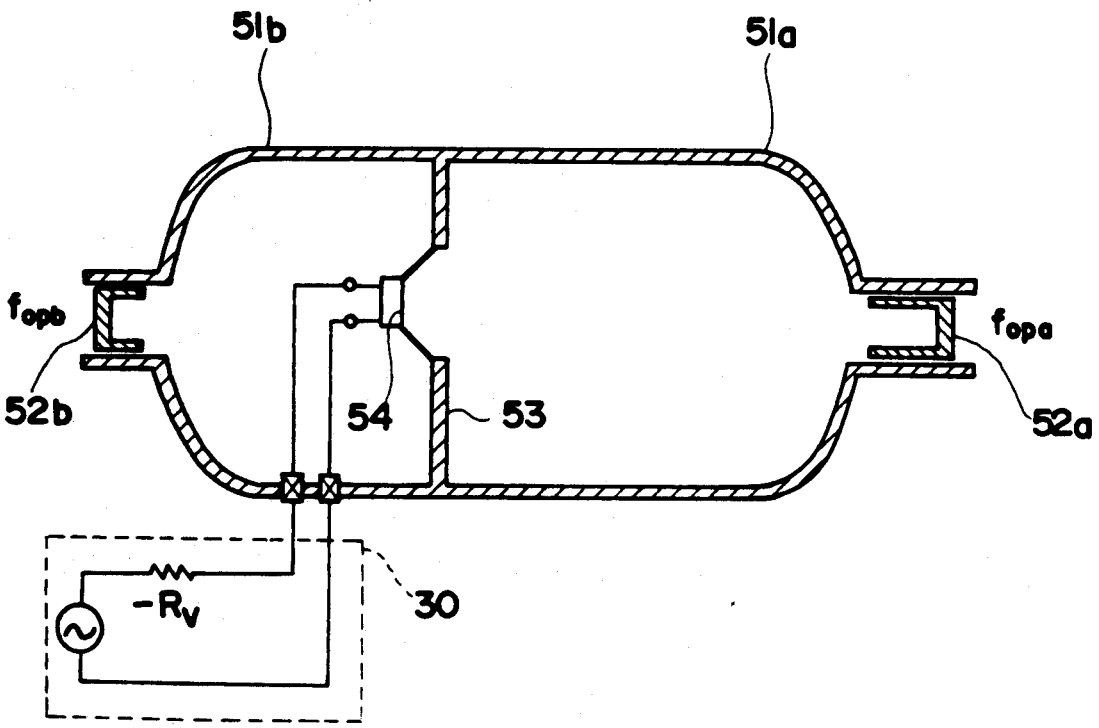
FIG. 17 is a diagram for explaining another concrete example of the third embodiment.

FIG. 17 shows another concrete example of the third embodiment. As shown in the Figure, a resonator comprises first and second resonators 51*a* and 51*b*, which have passive diaphragms 52*a* and 52*b* which are movable right and left directions, respectively. A hole is formed in a partition wall 53 between the resonators 51*a* and 52*b*, and a dynamic speaker 54 is mounted therein. The speaker 54 is driven by a drive controller 30 equivalently having a negative output impedance $(-R_v)$ and is not influenced by atmospheric counteractions from the first and second resonators 51*a* and 51*b*, and its active diaphragm equivalently becomes a part of wall surfaces of these resonators. In this case, resonance systems A and B have independent resonance frequencies $f_{opa}$ and $fop_b$, respectively.

A fourth embodiment of the present invention will be described hereinafter.

Figure 18A:
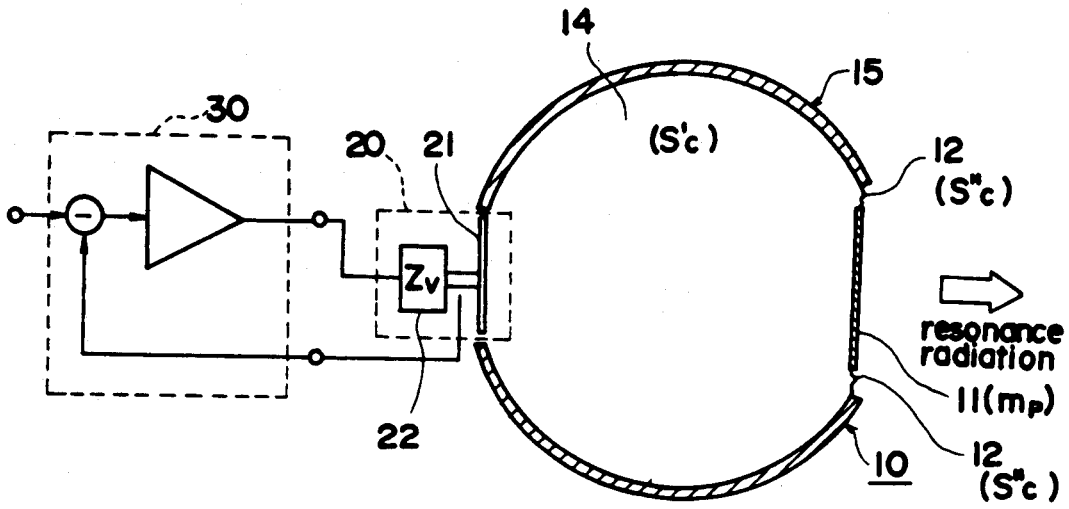
FIGS. 18(*a*) and 18(*b*) are diagrams for explaining a basic arrangement of a fourth embodiment of the present invention.
Figure 18B:
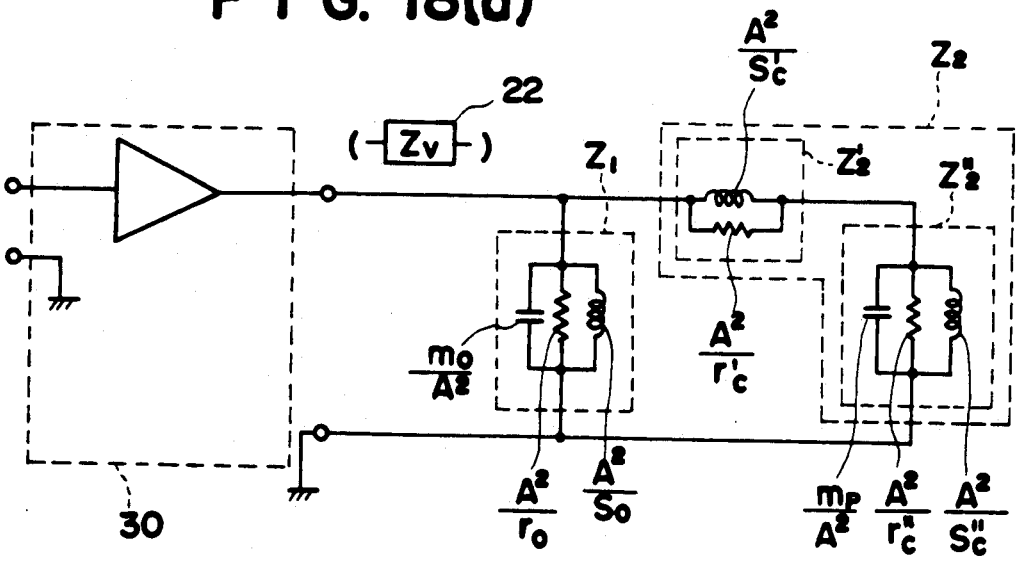

FIG. 18(*a*) shows a basic arrangement concerned. In this embodiment, a vibrator driver 30 comprises a motional feedback (MFB) unit for detecting, by using any appropriate method, motional signal corresponding to movement of the active diaphragm 21 and negatively feeding back the signal to the input side of the driver 30. The constitution of an electric equivalent circuit of the acoustic apparatus is quite the same as that shown in FIGS. 7(*b*) and 8 for explaining the third embodiment.

As indicated in FIG. 8, the original impedance equivalent circuit of the vibrator 20 is composed of a series circuit wherein said equivalent motional impedance $Z_M$ and the inherent internal impedance $Z_v$ of the transducer 22 are included, as viewed from electric equivalency. The motional signal $S_M$ to be detected from the equivalent motional impedance $Z_M$ includes the voltage across the equivalent motional impedance, the differential output or integral output thereof; these factors so included correspond respectively to the vibration velocity, vibration acceleration and vibration displacement (amplitude) of the active diaphragm 21. The motional feedback constitution or arrangement provided in the vibrator driver 30 has a motional signal detecting unit 24 for detecting as the motional signal an amount corresponding to any one of said factors, and a motional signal $S_M$ so detected is negatively fed back through a feedback unit 25 to the input side of the vibrator driver 30.

The operation of the acoustic apparatus with the arrangement shown in FIG. 18(*a*) will be briefly described below.

When a drive signal is supplied from the vibrator driver 30 having a motional feedback function to the transducer 22 of the vibrator 20, the transducer 22 electromechanical converts the drive signal so as to reciprocally drive the active diaphragm 21 forward and backward (in the right and left directions in the Figure). Since the vibrator driver 30 has a motional feedback unit, if the amount of negative feedback is extremely large, the condition of driving the vibrator driver 30 is brought under follow-up control so that a signal in an amount corresponding to the drive input is always correctly transmitted as the terminal voltage across said equivalent motional impedance, the differential voltage and integral voltage of said terminal voltage. In other words, motional voltages applied to the equivalent motional impedance are controlled so that they correspond to the drive input in a relation of 1:1. Accordingly, the vibrator driver 30 is apparently become equivalent to subjecting the equivalent motional impedance itself of the vibrator 20 directly to linear, integral or differential driving, and the internal impedance inherent in the transducer 22 is effectively invalidated. Therefore, the transducer 22 drives the active diaphragm 21 faithfully in response to the drive signal from the vibrator driver 30, and independently supplies a drive energy to the resonator 10.

In this case, the front surface side (the right surface side in the Figure) of the active diaphragm 21 serves as a resonance driver portion for driving the resonator 10, and is effected an atmospheric counteraction from air in the cavity of the resonator 10. However, the vibrator driver 30 drives the vibrator 20 by the motional feedback operation so as to cancel the atmospheric counteraction. This is because the internal impedance $Z_v$ inherent in the transducer 22 of the vibrator 20 is effectively invalidated. Hence, the diaphragm 21 becomes an equivalent wall of the resonator 10, and the resonance Q value ideally becomes infinite. Accordingly, as in the third embodiment, by adjusting an equivalent mass of the passive diaphragm 11, sound pressure-frequency characteristics shown in, e.g., FIG. 12 can be obtained.

The constitution of the vibrator driver 30 of the fourth embodiment is quite the same as that of the second embodiment and, therefore, the same explanation may apply to the fourth embodiment. For example, the fourth embodiment of the invention is also characteristic of so-called excessive compensation being not caused at all. Therefore, in this embodiment, an extremely large amount of negative feedback may be effected, so that the internal impedance $(R_v, L_v)$ is almost completely invalidated whereby there can be realized a bass reproduction entirely without including distortions caused by the transient response of the vibration system. Further, by additionally controlling the drive input level of the vibrator driver, the same flat sound pressure-frequency characteristics as conventional can finally be realized and, further, said characteristics can be extended to a lower region depending on the contents of said drive input level control.

The shape of the cavity portion may be, for example, spheric, rectangular in section or cubic. The vibrators which may be used include dynamic type, electromagnetic type, piezoelectric type, and electrostatic type vibrators. Motional feedback and motional signal detection may also be effected by the use of the system indicated above in the explanation about the second embodiment.

A concrete example of the fourth embodiment will be explained below.

Figure 19:
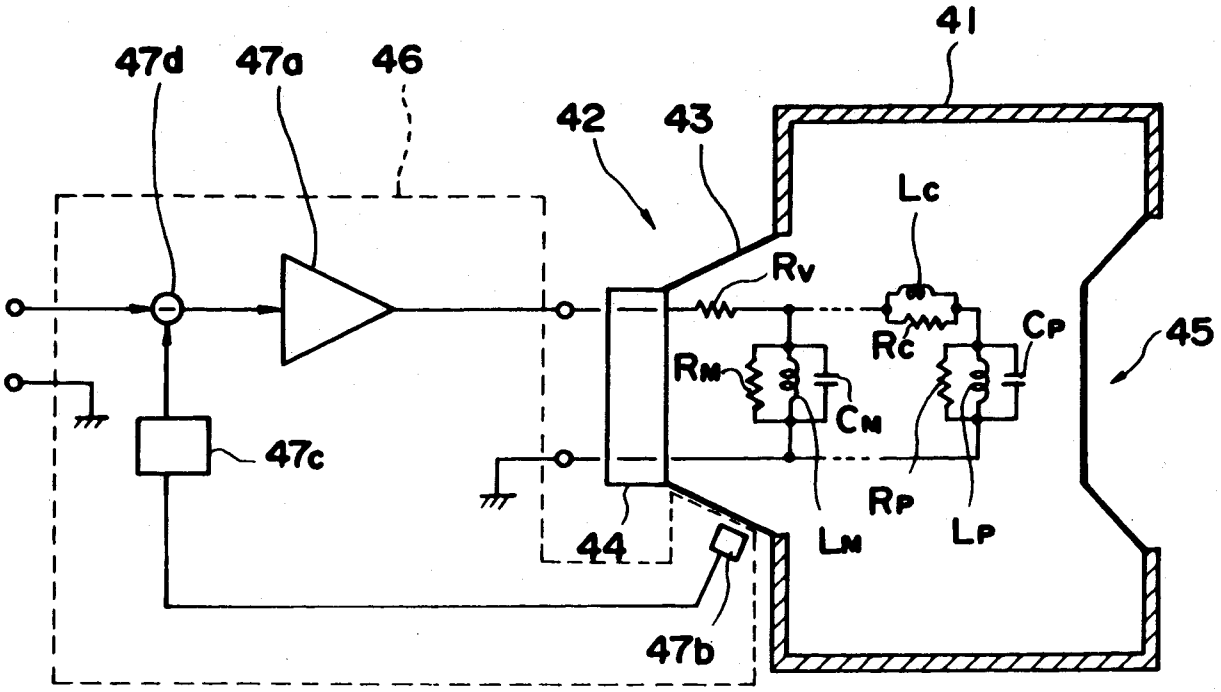
FIG. 19 is a diagram showing a concrete example of the fourth embodiment.

FIG. 19 is a diagram of a concrete example wherein this invention is applied to a rectangle-prismatic shaped cabinet. As shown in the Figure, a dynamic speaker 42 is mounted on the rear surface of a rectangle-prismatic shaped cabinet 41, and on its opposite side, a conical shaped passive diaphragm 45 is disposed whereby the passive diaphragm 45 forms a virtual woofer characterizing the present invention. A driver circuit 46 has a driver unit 47*a* having a large-open-loop gain, a detecting unit 47*b* for detecting the motional voltage applied to the equivalent motional impedance of the dynamic transducer 44 of the speaker 42, a feedback unit 47*c* for effecting a predetermined conversion on the output of the detecting unit 47*b*, and a subtracter 47*d* for negatively feeding back the motional signal outputted from the feedback unit 47*c* to the input side of the driver circuit 46. The dynamic transducer 44 is driven by the output of the driver circuit 46.

The dynamic transducer 44 has a voice coil DC resistance $R_v$ as an inherent internal impedance, which can be apparently invalidated by the feedback driving of the driver circuit 46.

With this arrangement, a virtual speaker 45' equivalently formed by the passive diaphragm 45 is equivalent to a state wherein it is mounted on a closed cabinet 41' having an infinite volume. The virtual speaker 45' is equivalently connected to a conventional amplifier 49 (which is not subjected to active servo drive) through an equivalently formed low-pass filter (LPF).

In this example, sound pressure-frequency characteristics of the resonator can be arbitrarily set by increasing/decreasing an input signal level according to the signal frequency by the amplifier. In the circuit shown in FIG. 17, such adjustment is realized by e.g. the BPF circuit 220.

Effect of the Second Aspect of This Invention

With the above arrangement, a vibrator having an active diaphragm for driving a resonator has an inherent internal impedance. Since the vibrator is driven so that the atmospheric counteraction caused from the resonator is canceled, the active diaphragm equivalently becomes the wall of the resonator and the presence of the vibrator is invalidated from the standpoint of the resonator. Accordingly, the internal impedance inherent in the vibrator does not constitute a factor which reduces the resonance Q value of the resonator. For this reason, the resonance Q value is extremely heightened and this is true when negative impedance drive is carried out or when motional feedback drive is effected. Thus, the acoustic resistance as the resonator, is increased by using a miniaturized resonator and lowering the resonance frequency; therefore, the resonance Q value will not be lowered according to this invention even in a case where the resonance Q value is greatly lessened according to the usual drive system.

In addition, the resonance frequency of the resonator may be easily lowered by increasing the equivalent mass of the passive diaphragm, and a decrease in acoustic radiation capabilities which is caused by increasing the equivalent mass of the passive diaphragm and lowering the resonance frequency is slight as compared with such a decrease which is caused by increasing the air mass. This enables a miniaturized (especially thinned) cabinet to be used and its caliber to be optionally designed, resulting in that the cabinet has satisfactory acoustic radiation capabilities although it is a small-sized one.

What is claimed is:

1. An acoustic apparatus, comprising:

a body portion having an internal cavity therein defining a resonator and a passive diaphragm operatively coupled to said body portion, wherein said passive diaphragm functions as a resonance radiation unit for radiating an acoustic wave caused by resonance;

a vibrator disposed in the body portion and having an active diaphragm including a direct radiation portion for directly radiating can acoustic wave and a resonator driver portion for driving said resonator; and vibrator drive means for driving said vibrator, said vibrator drive means being coupled to said vibrator and comprising drive control means for controlling a drive condition of said vibrator, wherein an atmospheric counteraction of said resonator is substantially cancelled at a time of driving of said resonator by said vibrator.

2. An acoustic apparatus according to claim 1, wherein said body portion comprises a cabinet having an inner surface within said internal cavity and an outer surface and further having a first opening in which said vibrator is disposed and a second opening in which said passive diaphragm is disposed, and further wherein said active diaphragm of said vibrator has an outer facing portion facing in direction of said outer surface of said cabinet, said outer facing portion constituting said direct radiator portion and an inner facing portion facing in a direction said inner surface of said cabinet, said inner facing portion constituting said resonator driver portion.

3. An acoustic apparatus according to claim 1, wherein said drive control means comprises a negative impedance generating means for equivalently generating a negative impedance component in an output impedance of said vibrator drive means.

4. An acoustic apparatus according to claim 1, wherein said vibrator drive means comprises a motional feedback means for detecting a motional signal corresponding to movement of said active diaphragm and effecting negative feedback of the motional signal to an input side of said vibrator, thereby to effect motional feedback drive of said vibrator.

5. An acoustic apparatus, comprising:

a body portion having an internal cavity therein defining a resonator and a passive diaphragm operatively coupled to said body portion, wherein said passive diaphragm functions as a resonance radiation unit for radiating an acoustic wave caused by resonance;

a vibrator disposed in the body portion and having an active diaphragm including a resonator driver portion for driving said resonator; and vibrator drive means for driving said vibrator, said vibrator drive means being coupled to said vibrator and comprising drive control means for controlling a drive condition of said vibrator, wherein an atmospheric counteraction of said resonator is substantially cancelled at a time of driving of said resonator by said vibrator.

6. An acoustic apparatus according to claim 5, wherein said drive control means comprises a negative impedance generating means for equivalently generating a negative impedance component in an output impedance of said vibrator drive means.

7. An acoustic apparatus according to claim 5, wherein said vibrator drive means has a motional feedback means for detecting a motional signal corresponding to movement of said active diaphragm and effecting a negative feedback of the motional signal to an input side of said vibrator, thereby to effect motional feedback drive of said vibrator.

8. An acoustic apparatus according to claim 5, wherein said body portion comprises a cabinet having an inner surface within said internal cavity and an outer surface and further having a first opening in which said vibrator is disposed and a second opening in which said passive diaphragm is disposed, and further wherein said active diaphragm of said vibrator has an inner facing portion facing in a direction of said inner surface of said cabinet, said inner facing portion constituting said resonator driver portion.

* * * * *